US011736861B2

(12) United States Patent
Horbach et al.

(10) Patent No.: US 11,736,861 B2
(45) Date of Patent: Aug. 22, 2023

(54) AUTO-CALIBRATING IN-EAR HEADPHONE

(71) Applicant: HARMAN INTERNATIONAL INDUSTRIES, INCORPORATED, Stamford, CT (US)

(72) Inventors: Ulrich Horbach, Oberschneiding (DE); Keyvan Amini Khoiy, Stamford, CT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/327,334

(22) Filed: May 21, 2021

(65) Prior Publication Data

US 2021/0377659 A1 Dec. 2, 2021

(30) Foreign Application Priority Data

May 26, 2020 (EP) ..... 20176657

(51) Int. Cl.

| | |
|---|---|
| ***H04R 3/04*** | (2006.01) |
| ***G10K 11/178*** | (2006.01) |
| ***H04R 1/10*** | (2006.01) |
| ***H04S 7/00*** | (2006.01) |

(52) U.S. Cl.

CPC ..... *H04R 3/04* (2013.01); *G10K 11/178* (2013.01); *H04R 1/1016* (2013.01); *H04R 1/1083* (2013.01); *H04S 7/301* (2013.01); *H04R 2460/01* (2013.01)

(58) Field of Classification Search

CPC ..... H04R 3/04; H04R 1/1016; H04R 1/1083; H04R 2460/01; G10K 11/178; G10K 11/17827

See application file for complete search history.

(56) References Cited

U.S. PATENT DOCUMENTS

| | | | | |
|---|---|---|---|---|
| 11,115,750 | B2 * | 9/2021 | Monsarrat-Chanon | H04R 1/1083 |
| 2007/0195963 | A1 * | 8/2007 | Ko | H04S 7/306 381/26 |
| 2008/0181419 | A1 * | 7/2008 | Goldstein | G10K 11/17827 381/57 |

(Continued)

FOREIGN PATENT DOCUMENTS

| | | | |
|---|---|---|---|
| DE | 102015003855 | A1 | 9/2016 |
| EP | 3644307 | A1 | 4/2020 |

OTHER PUBLICATIONS

Liski et al., "Real-Time Adaptive Equalization for Headphone Listening", 2017 25th European Signal Processing Conference (EUSIPCO), 5 pages.

*Primary Examiner* — Jason R Kurr
(74) *Attorney, Agent, or Firm* — Artegis Law Group, LLP

(57) ABSTRACT

A method for calibrating an in-ear headphone to improve the frequency response heard by a user. The method including generating a sound signal and playing the sound signal at a driver when the in-ear headphone is placed within a user's ear canal, receiving a reflected sound signal at a first microphone, generating a frequency response based on the reflected sound signal, generating the user's ear drum response based on the frequency response, generating a second sound signal, modifying the second sound signal based on the user's ear drum response, and playing the modified second sound signal at the driver.

20 Claims, 24 Drawing Sheets

(56) References Cited

U.S. PATENT DOCUMENTS

| | | | | |
|---|---|---|---|---|
| 2010/0266136 | A1* | 10/2010 | Kelloniemi | G10K 11/17823 381/71.11 |
| 2015/0049892 | A1* | 2/2015 | Petersen | H04R 25/554 381/315 |
| 2017/0289328 | A1* | 10/2017 | McGregor | H04R 1/1041 |
| 2019/0191236 | A1* | 6/2019 | Rauschmayer | H04R 29/001 |
| 2021/0345033 | A1* | 11/2021 | Yu | H04R 1/1083 |

* cited by examiner

AUTO-CALIBRATING IN-EAR HEADPHONE

CROSS-REFERENCE TO RELATED APPLICATION

This application claims the benefit of European Patent Application No. 20176657.3, titled "Auto-calibrating In-ear Headphone," filed on May 26, 2020, the subject matter of which is incorporated by reference herein in its entirety.

BACKGROUND

Technical Field

The present document generally relates to methods of automatic calibration of in-ear headphones and corresponding apparatus. Calibration is used to improve the frequency responses heard by a user.

Description of the Related Art

With the increased development of technology in the sound industry, it is possible to reproduce high quality sound from smaller and more sophisticated drivers within headphones. However, users will receive different frequency responses at their ear drums due to the individual characteristics of the user's ears (such as the specific dimensions and shape of the interior of the ear canal and how much sound is absorbed in the user's ear canal). In order to achieve an optimized and similar frequency response for all users the headphones should be calibrated, i.e., equalized individually. The headphone transfer function (HpTF) describes how the sound is filtered by the ear on its path from the sound source to the eardrum. With appropriate individual HpTF's available, headphones can be equalized using the HpTF's as filters at the eardrum. Consequently, an audio signal can be more accurately reproduced at the eardrum after the HpTF filtering and playback through the headphones in question. With conventional headphones the HpTFs are very difficult to measure and expensive/specialist professional equipment is needed for the task.

Previous attempts at measuring the HpTF include producing a sound sweep in an ear of a user with the use of a transducer within a specially moulded earpiece, and recording the properties of the ear with a microphone placed within the earpiece. However, these attempts did not include an accurate model to predict ear canal properties and interactions between the individual user's ear and the moulded earpiece. Furthermore, previous attempts at equalizing headphones using filters have only aimed at producing flat frequency responses (i.e. flat spectrum) at the ear drum. This, however, does not take into account the user's individual Head related Transfer Function (HrTF). Therefore, the user may still experience a different frequency response than that generated by the headphones.

Furthermore, in-ear headphones are known to provide high quality sound to a user by creating a closed seal with the ear drum and the outside world, thereby blocking out most environmental or background noises. To provide a further immersed seal to the outside world, some in-ear headphones comprise active noise cancelling (ANC) control systems. However, blocking out of environmental noises can be a problem when environmental sounds are necessary for safety or other reasons (such as on a construction site or when a user is walking across a road). A user could pause the music and switch the ANC control systems off, thereby providing reduced noise cancellation. However, this still leaves damping of environmental noises through the closed seal of the in-ear headphones. The user would have to remove the in-ear headphones to hear environmental background noises.

Although there is the possibility of recording environmental noises with the ANC control system and playing these back to the user, previous attempts do not take into account the individual characteristics of the user's ears. Therefore, the user does not perceive the environmental sounds as accurately as if he/she were not wearing headphones.

Accordingly, there is a need in the industry to provide an improved method of equalising headphones (for example, noise cancelling in-ear headphones) based on the individual characteristics of the user's ears (pinna and ear canal), such that the user hears the intended sound (frequency responses), and to integrate an ambient listening mode into the headphones to allow the user to hear environmental background noises as if he/she were not wearing the headphones without removing the headphone.

It is therefore an aim to measure the anatomy of the user's ears and accordingly to modify the sound produced at the headphones such that the user experiences the intended reproduced sound. Furthermore, it is an aim to provide a noise cancelling in-ear headphone which can reproduce and similarly modify environmental and background noises at the headphone to the user such that the user experiences the environmental and background noises as if he/she were not wearing the headphones without removing the headphone.

SUMMARY

To overcome the problems detailed above, the inventors have devised novel and inventive auto-calibrating apparatus and techniques.

More specifically, claim 1 provides a method of calibrating an in-ear headphone in accordance with an embodiment. An integrated circuit within an in-ear headphone can generate a sound signal (for example, a logarithmic sweep) and play the sound signal at a driver when the in-ear headphone is placed within a user's ear canal. The sound signal travels through the user's ear canal, reflects off the ear drum and travels back to the in-ear headphone, where the reflected sound signal is received and recorded by a first microphone of the in-ear headphone. The integrated circuit can generate a frequency response based on the reflected sound signal and further generate the user's ear drum response based on the frequency response (for example, by determining the length of the user's ear canal and by estimating a damping coefficient of the user's ear canal using a two-stage transmission line and an ear drum pressure transfer function). The integrated circuit of the in-ear headphone can further generate a second sound signal from an audio input (for example, a laptop, smartphone or similar) and modify the second sound signal based on the user's ear drum response. Furthermore, the driver of the in-ear headphone can play back the modified second sound signal to the user. Advantageously a modified sound (e.g. music or audio) can be generated by the in-ear headphone, such that the frequencies that are damped in a user's ear canal are compensated for. Therefore a user hears the intended sound (frequency response).

In an embodiment a third sound signal can be generated, by a separate (e.g. external) driver, wherein the third sound signal can be received at the entrance of a user's ear canal (for example, by a second microphone of the in-ear headphone and/or by a separate test microphone arrangement). The integrated circuit can generate a second frequency response based on the received third sound signal which equates to a user's target function. Furthermore, the integrated circuit can further modify the second sound signal towards the user's target function. Advantageously, the in-ear headphone can compensate for sound (frequency response) lost both in the ear-canal and at the entrance of the ear-canal by the outer ear (pinna). Furthermore, the in-ear headphone can receive and modify ambient (e.g. environmental and background) sounds to create an improved active noise cancelling. Further still, the in-ear headphone can modify the recorded ambient sounds to play them back to the user through the in-ear headphone, thereby providing transparent hearing to the user without the need of removing the in-ear headphones.

An in-ear headphone is set out in claim 11. The in-ear headphone includes a housing with a body portion and a nozzle portion, wherein the nozzle portion comprises an aperture therein. The housing further includes a driver, a first microphone, a second microphone opposite the first microphone, and an integrated circuit coupled to the first microphone, the second microphone and driver. The integrated circuit is operable to generate a sound signal (for example, a logarithmic sweep) and play the sound signal at a driver when the in-ear headphone is placed within a user's ear canal. The sound signal travels through the user's ear canal, reflects off the ear drum and travels back to the in-ear headphone, where the reflected sound signal is received and recorded by a first microphone of the in-ear headphone. The integrated circuit can generate a frequency response based on the reflected sound signal and further generate the user's ear drum response based on the frequency response (for example, by determining the length of the user's ear canal and by estimating a damping coefficient of the user's ear canal using a two-stage transmission line and an ear drum pressure transfer function). The integrated circuit of the in-ear headphone can further generate a second sound signal from an audio input (for example, a laptop, smartphone or similar) and modify the second sound signal based on the user's ear drum response. Furthermore, the driver of the in-ear headphone can play back the modified second sound signal to the user. Advantageously a modified sound (e.g. music or audio) can be generated by the in-ear headphone, such that the frequencies that are damped in a user's ear canal are compensated for. Therefore a user hears the intended sound (frequency response).

Advantageously, the present embodiment can automatically and accurately measure a user's ear drum response and a user's target function. Therefore, the in-ear headphone can modify sound signals such that the frequency response received at a user's ear drum resembles, as closely as possible, the target function, thereby providing the user with the sound experience intended by the sound source. Furthermore, the present embodiment allows for transparent and binaural hearing of environmental (ambient) noises by the user without removing the in-ear headphones, while equally providing efficient active noise cancellation, all in a small package.

DETAILED DESCRIPTION

Auto-Calibration Method

The method of auto-calibrating in-ear headphones of the embodiment will now be described in detail.

Figure 1:
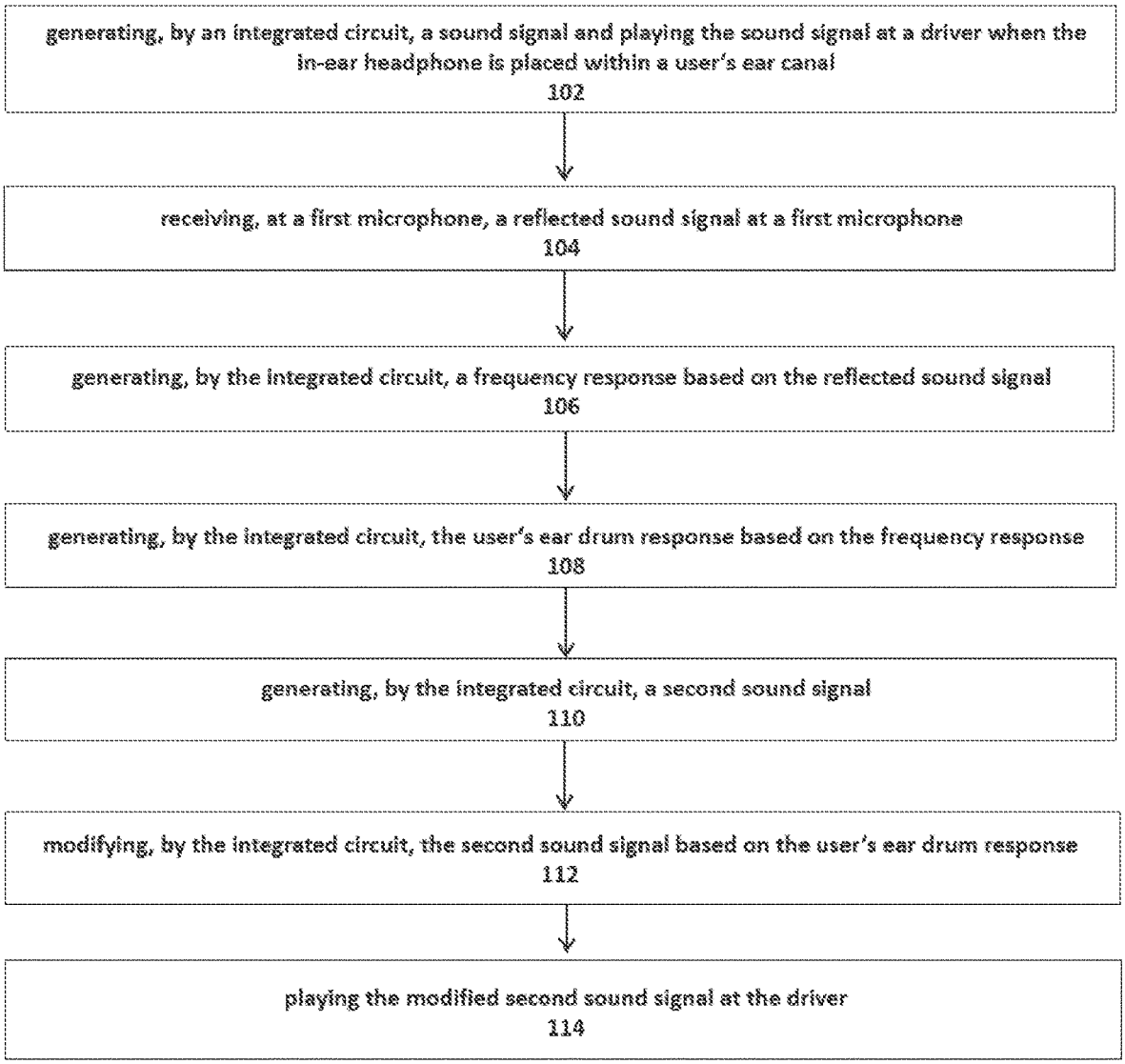
FIG. 1 is a flow diagram showing a process of calibrating an in-ear headphone.
Figure 21:
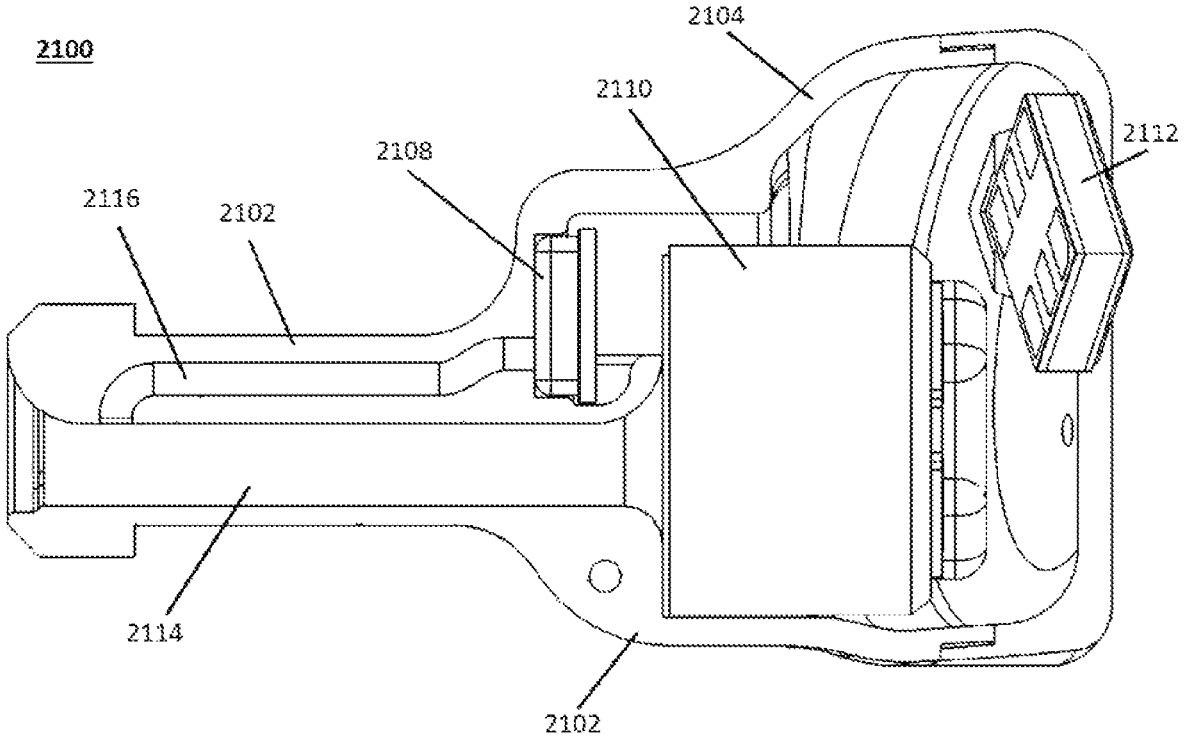
FIG. 21 is a side-on view of an in-ear headphone showing the two microphones, the first connecting canal and the second connecting canal, and the driver.
Figure 22:
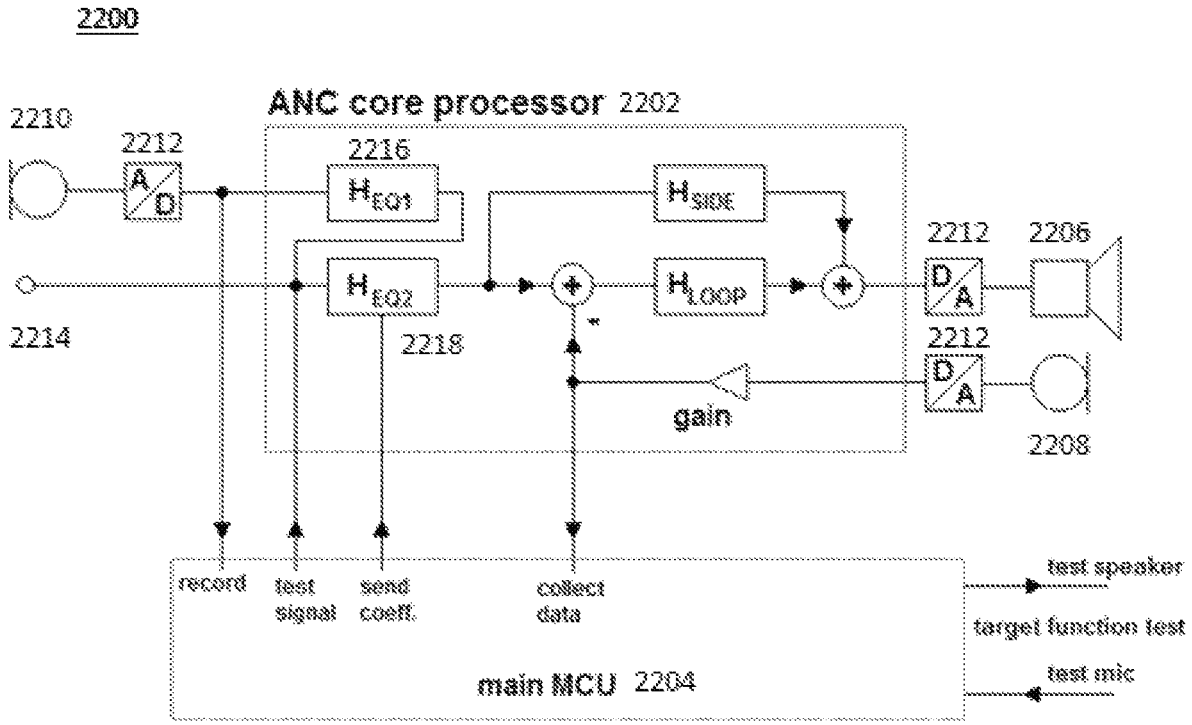
FIG. 22 is an exemplary view of the integrated circuit of the in-ear headphone.

FIG. 1 shows a simplified flow diagram of the method of auto-calibrating an in-ear headphone. The method may be carried out by an in-ear headphone as shown in FIGS. 21 and 22 comprising a driver, a first microphone and an integrated circuit. Further details of the in-ear headphone are discussed below. At step 102, an integrated circuit of the in-ear headphone generates a sound signal to be played to the user when the in-ear headphone is placed within the user's ear canal. The sound signal may be a logarithmic sweep generated by the integrated circuit of the in-ear headphone and may have a duration of one second. The sound signal can be played by the driver of the in-ear headphone, wherein the driver may be any well-known speaker capable of playing back high-quality sound to the user. Additionally, the driver may be a dynamic (moving coil) type driver and may have a diameter of 5-8 mm, a balanced armature (BA) driver, or a combination of both.

Figure 2:
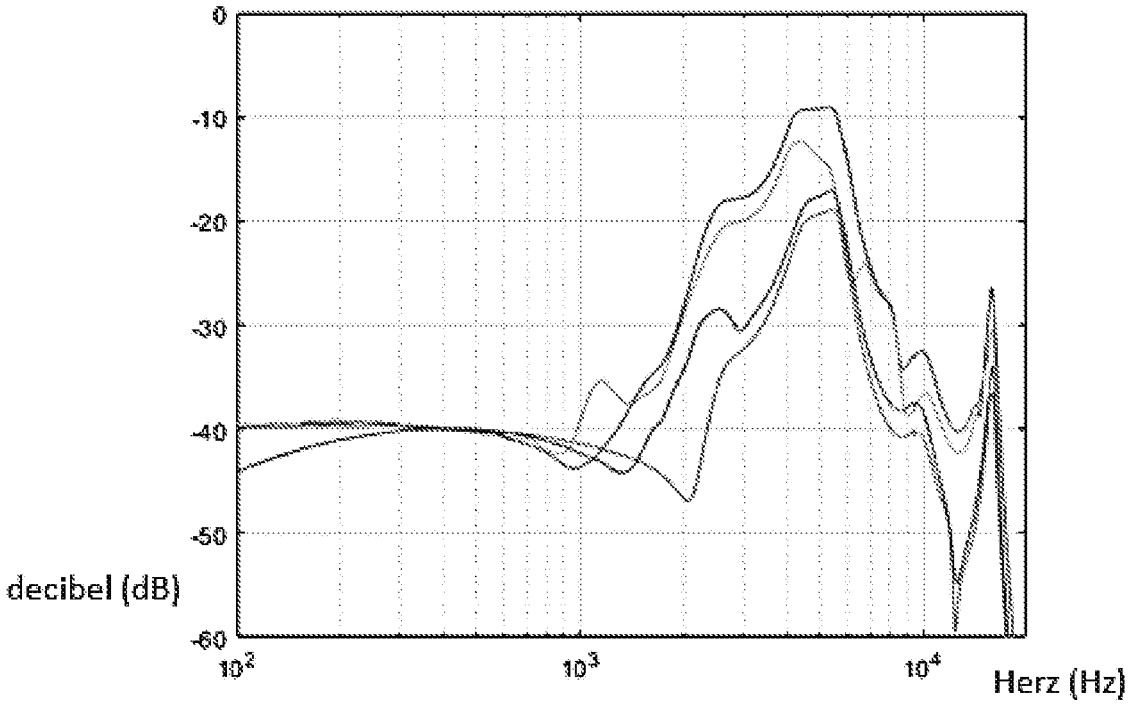
FIG. 2 shows example frequency responses of four people recorded at a first microphone of an in-ear headphone.

The sound signal played by the driver will reflect from the user's ear drum and, at step 104, the first microphone of the in-ear headphone receives the reflected sound signal. The reflected sound signal is transmitted from the first microphone to the integrated circuit which, at step 106, generates a frequency response based on the reflected sound signal received at the first microphone, using well known signal processing methods. The integrated circuit may generate an error message in the event that the frequency response drops at low frequencies, which indicates that a poor seal is present at the entrance to the ear canal (i.e. between the earphone and the user's ear). FIG. 2 shows examples of frequency responses generated based on a logarithmic sweep for four test people. As shown in FIG. 2, the example frequency responses of the four test people varies, thereby justifying the need of individual calibration of in-ear headphones.

At step 108, the integrated circuit can generate the user's ear drum response from the measured frequency response. For example, the integrated circuit can derive the unknown length of the user's ear canal at a first recorded minimum frequency using a simple two-stage acoustic transmission line. In an acoustic transmission line (a tube with constant cross section), the input sound pressure $p_{in}$ and volume velocity $q_{in}$ can be computed from the output variables $p_{out}$ and $q_{out}$ by multiplying the output vector with a transmission matrix C as follows:

$$\begin{bmatrix} p_{in} \\ q_{in} \end{bmatrix} = C \begin{bmatrix} p_{out} \\ q_{out} \end{bmatrix}; \quad \text{[Equation 1]}$$

$$C = \begin{bmatrix} \cosh x & Z_T \sinh x \\ Z_T^{-1} \sinh x & \cosh x \end{bmatrix};$$

$$x = \left(\alpha + j\frac{2\pi f}{c}\right) * l;$$

$$Z_T = \frac{\rho_g t}{A}.$$

(l=length of tube, A=cross section area, α=damping coefficient, and $Z_T$=input impedance).

In the embodiment, the passage from the headphone driver to an exit aperture of the in-ear headphone and the ear canal are considered as two separate transmission lines (the 'passage' is also termed a 'nozzle' or a 'connecting canal' herein). A cascade of two transmission lines $C=C_1*C_2$, where $C_1$ represents the nozzle (i.e. the transmission line/passage/connecting canal between the driver and the end of the in-ear headphone) and $C_2$ represents the ear canal, which is longer and has a larger radius. Therefore, the abrupt transition from the small diameter of the nozzle of the in-ear headphone to the ear canal's larger diameter is taken into account, thereby resulting in more accurate measurements of the frequency response at the user's ear canal. In an embodiment, the calculations approximate the interior walls of the ear drum to be hard reflecting surfaces; therefore the output velocity $q_{out}$ can be set to zero. With that approximation, the ear drum pressure transfer function $H_D=p_{out}/p_{in}$ can be computed as follows:

$$H_D = \left(\cosh x_1 \cosh x_2 + \frac{A_2}{A_1} \sinh x_1 \sinh x_2\right)^{-1}, \quad \text{[Equation 2]}$$

-continued with $$x_1 = l_1\left(\alpha_1 + j\frac{2\pi f}{c}\right);$$

$$x_2 = l_2\left(\alpha_2 + j\frac{2\pi f}{c}\right).$$

The unknown parameters $l_1$, $l_2$, $A_1$, $A_2$, $\alpha_1$ and $\alpha_2$ can be used to determine the ear drum pressure from the measured response at the first microphone. In an embodiment, fixed values can be used for the damping coefficients $\alpha_1$ and $\alpha_2$, such as 0.02. However, the damping coefficient can be varied to achieve a more accurate result, as will be described later. The nozzle length $l_1$ is fixed (for example, at 6 mm).

The remaining unknown length parameter of the ear canal $l_2$ can be derived from the first recorded minimum $f_m$ of the measured frequency response function at the nozzle, which may vary between 900 Hz and 2100 Hz as shown in FIG. 2. This minimum corresponds to a zero of the pressure transfer function $H_D$ at the frequency $f_m$. To obtain a useable equation, an undamped case may be considered (e.g. by setting the coefficients $\alpha_1$ and $\alpha_2$ to 0) and sin/cos terms may be used instead of sin h/cos h, leading to the following equation:

$$\cos(\alpha_1 f_m)\cos(\alpha_2 f_m) - d\sin(\alpha_1 f_m)\sin(\alpha_2 f_m) = 0, \quad \text{[Equation 3]}$$

with $$\alpha_{1/2} = \frac{2\pi}{c} l_{1/2}.$$

($c$ = speed of sound)

The unknown parameter $\alpha_2$ can then be calculated as follows:

$$\alpha_2 = \frac{1}{f_m} \operatorname{atan} \frac{1}{d\tan(\alpha_1 f_m)}, \quad \text{[Equation 4]}$$

$$d = \frac{A_2}{A_1}.$$

Accordingly, $l_2$ can be determined as $l_2=(c/2\pi)\ \alpha_2$.

In an embodiment, the in-ear headphone can be provided to the user with a number of ear tips with differing outer diameters, but with the same dimensions for the first acoustic transmission line (nozzle). The user can therefore select the ear tip that best fits their own ear, but the dimensions of the first acoustic transmission line (nozzle) will still be the same. The outer diameter and inner diameter values can be stored in the integrated circuit of the in-ear headphone. When carrying out the method, the user can input which of the plurality of ear tips the user has selected (for example, by means of a physical switch on the in-ear headphone, a user interface on the in-ear headphone, a wired or wireless connection from the in-ear headphone to a controller such as a smartphone, or any combination thereof), thereby allowing the ear canal to nozzle area ratio ($A_2/A_1$) to be calculated by the in-ear headphone.

Figure 3:
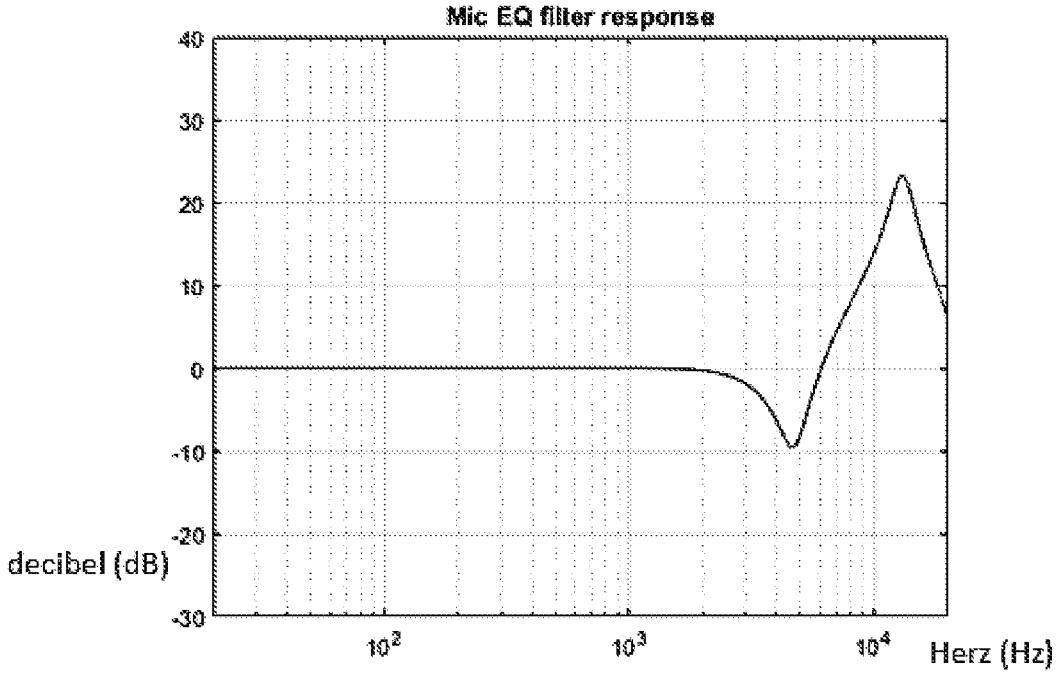
FIG. 3 shows a microphone equaliser function to compensate for the connecting canal to the first microphone.

FIG. 3 shows a microphone equaliser function (for example, a low order filter using two biquads) of an embodiment, which can be applied to the first microphone of the in-ear headphone (i.e. the first microphone affixed to the passage/nozzle/transmission line of the in-ear headphone) to compensate for frequency responses measured by the first microphone due to the microphone connecting canal as shown in FIG. 21 acting as a transmission line.

Figure 4:
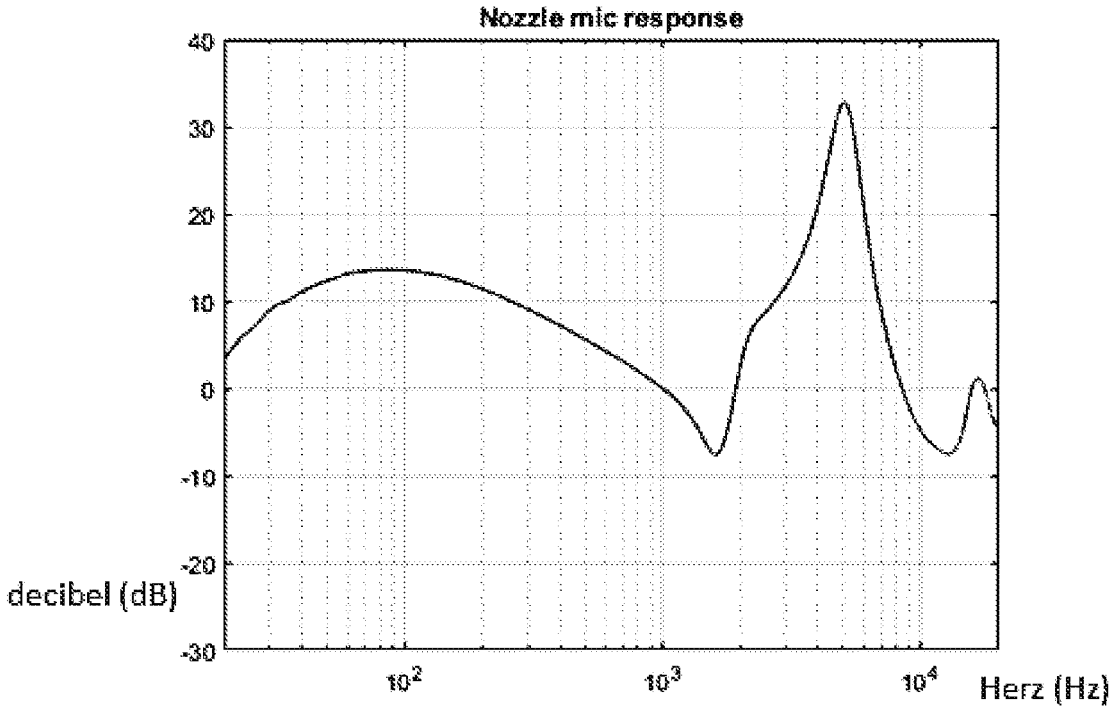
FIG. 4 shows a frequency response recorded by the first microphone of an in-ear headphone coupled with an acoustic coupler.
Figure 5:
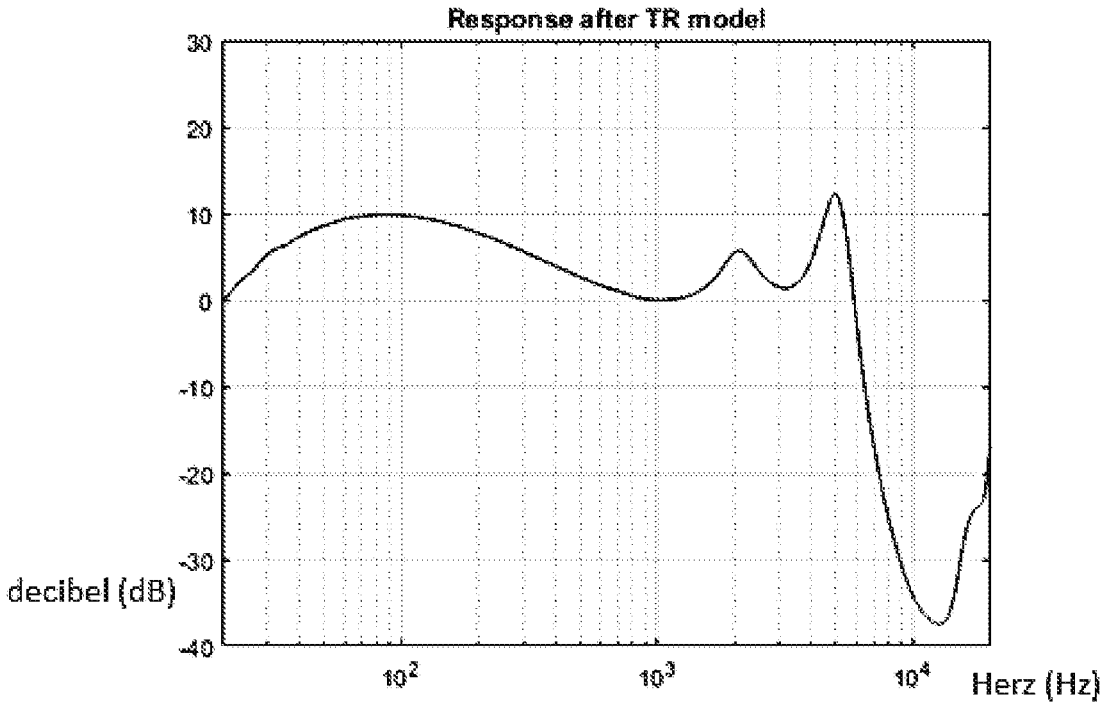
FIG. 5 shows a frequency response recorded by the first microphone in an in-ear headphone coupled with an acoustic coupler with a two-stage transmission line calculation.

The microphone equaliser can be determined by comparing a frequency response recorded by the first microphone with a frequency response recorded by the same type of microphone as the first microphone outside of the in-ear headphone (i.e. without the canal attached to it). This can be performed with a test arrangement wherein a sound source can be coupled to one end of a simple acoustic coupler (for example a foam tube) and the in-ear headphone can be coupled to the opposite end of the acoustic coupler. The sound source can play back a logarithmic sweep, as discussed above, which can be recorded and stored by the in-ear headphone (see FIG. 4 for results) to demonstrate what is recorded by the nozzle microphone. A simple two-stage acoustic transmission line calculation (as discussed above) can be applied to the recorded results of FIG. 4, wherein $C_1$ represents the nozzle (i.e. the transmission line between the first microphone and the end of the in-ear headphone), and $C_2$ represents the simple acoustic coupler (i.e. foam tube) which is longer and has a larger radius. Applying the two-stage transmission line calculation allows for a more accurate model of the frequency responses received by the nozzle microphone, the results of which are shown in FIG. 5.

Figure 6:
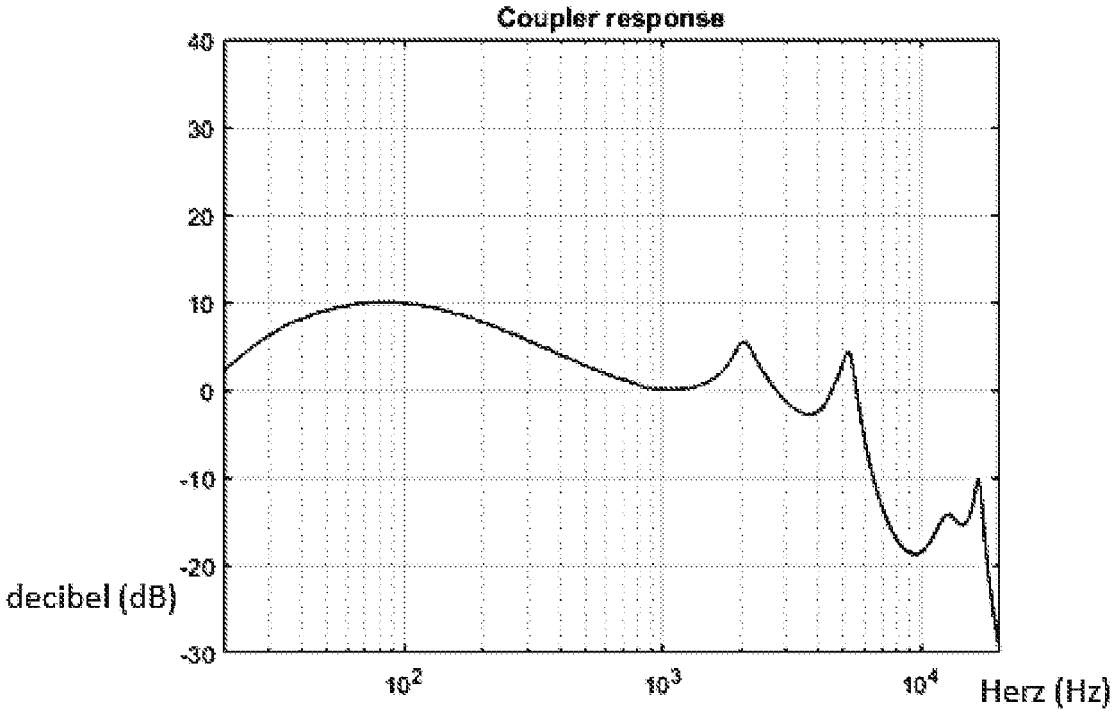
FIG. 6 shows a frequency response of an in-ear headphone measured at the simulated ear drum of an acoustic coupler.

The test arrangement can be repeated with the same type of microphone as in the in-ear headphone (i.e. the first microphone) but directly coupled to the acoustic coupler (i.e. without the passage/transmission line attached to it) and recording and storing the results by that microphone (see FIG. 6 for results) to demonstrate the frequency response recorded by the microphone without the microphone canal. Comparing the results from the test arrangement of the microphone within the in-ear headphone and the test arrangement of the microphone separately (as shown in FIG. 5 and FIG. 6, respectively) demonstrates which frequencies are lost in the canal. The microphone equaliser of FIG. 3, as discussed above, can be applied to the first microphone of the in-ear headphone to ensure that the frequency response measured by the in-ear headphone in the ear canal of a user takes into account the losses of the connecting canal, thereby leading to a more accurate measurement of the user's ear drum response.

Figure 7:
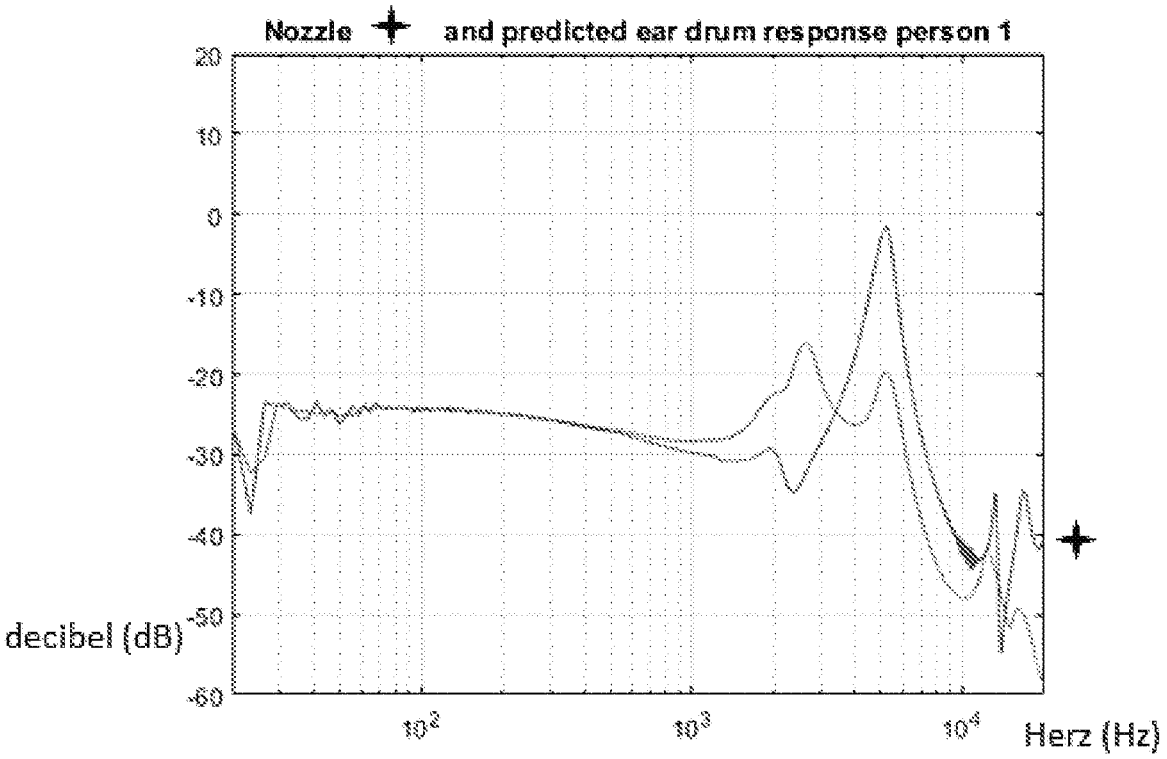
FIGS. 7-9 show example ear drum responses of three people's ear canals with and without two-stage transmission line calculations and microphone equaliser functions.
Figure 8:
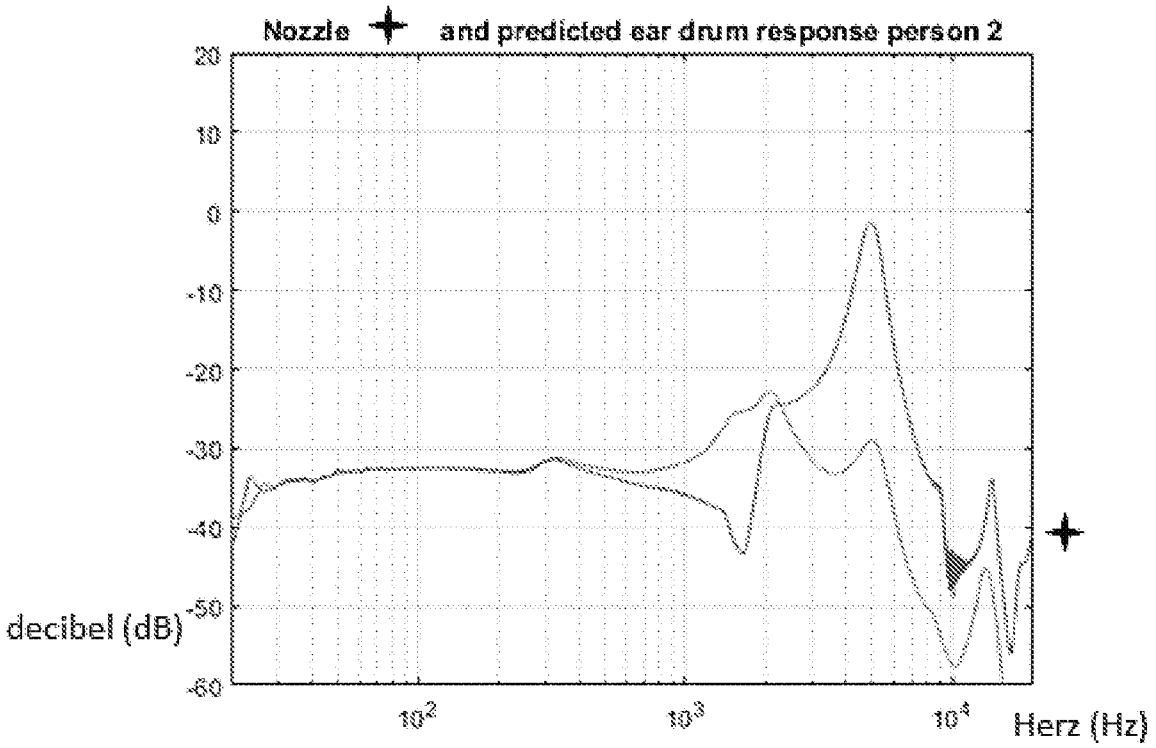
Figure 9:
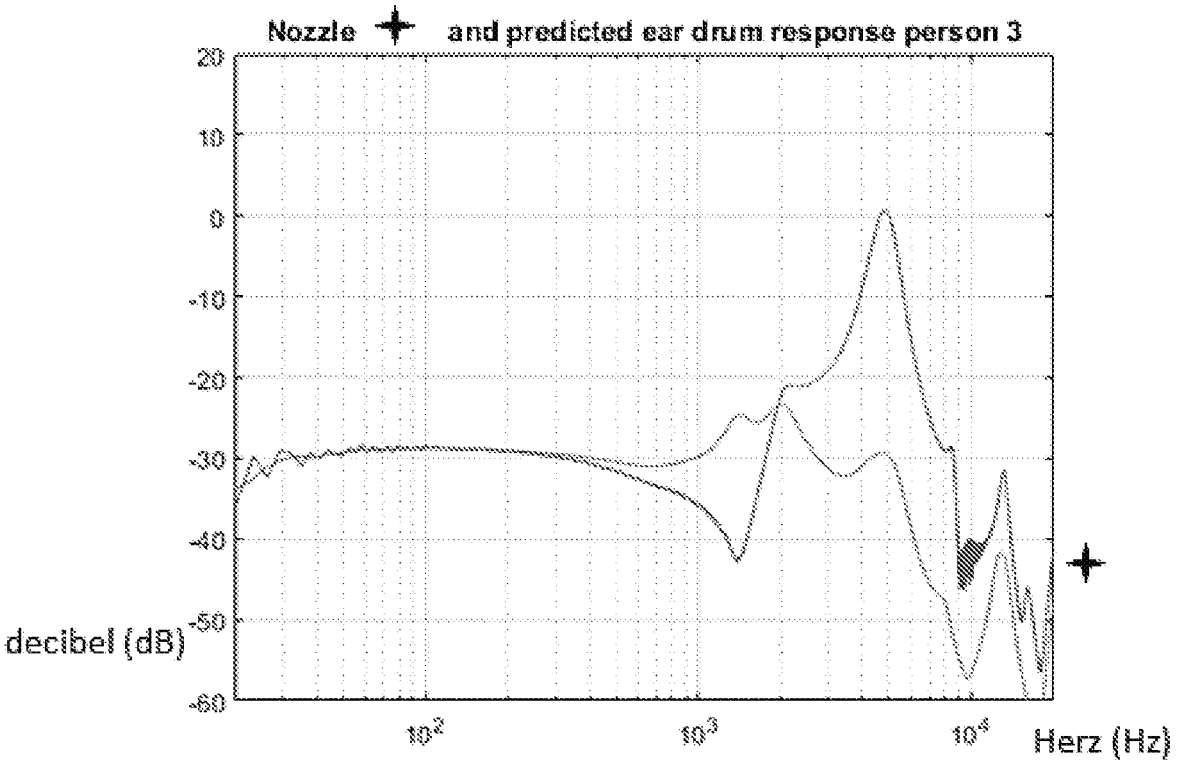

FIGS. 7 to 9 show comparisons between frequency responses measured at the first microphone of the in-ear headphone (i.e. before applying the two-stage transmission line calculation and the microphone equaliser) and the calculated frequency responses of users' ear drums (i.e. after applying both the two-stage transmission line calculation and the microphone equaliser) of three test people, based on the steps as described above.

Following the determination of the user's ear drum response, the integrated circuit of the in-ear headphone can, at step 110, generate a second sound signal, wherein the second sound signal may be a signal received from a separate audio input (e.g. a laptop, smartphone, MP3 player, or similar).

At step 112, the integrated circuit of the in-ear headphone can modify the second sound signal based on the user's ear drum response, as discussed above, by applying an equaliser function to the second sound signal which takes the user's ear drum response into account. The equaliser function can be applied by an equaliser coupled to the integrated circuit.

At step 114, the modified second sound signal may be transmitted to the driver of the in-ear headphone and subsequently played by the driver, such that the modified second sound signal is individually tailored to the user's ear drum response as outlined above. Accordingly, the frequency response at the user's ear drum can be altered throughout the frequency range, such that the user experiences the intended sound generated by the driver.

In an embodiment, the second sound signal may be further modified based on a user-specific target function. The user-specific target function can be measured by generating a frequency response at the entrance of the user's ear canal from an external sound source (such as external loudspeakers). In other words, the user-specific target function identifies how an external sound wave input is filtered by the diffraction and reflection of the individual characteristics of the user's ear (such as the pinna and ear canal) and the corresponding ear drum response of the user from the external sound wave. The further modification can alter the second sound signal towards the user-specific target function, such that user experiences the intended sound generated by the driver.

Figure 23:
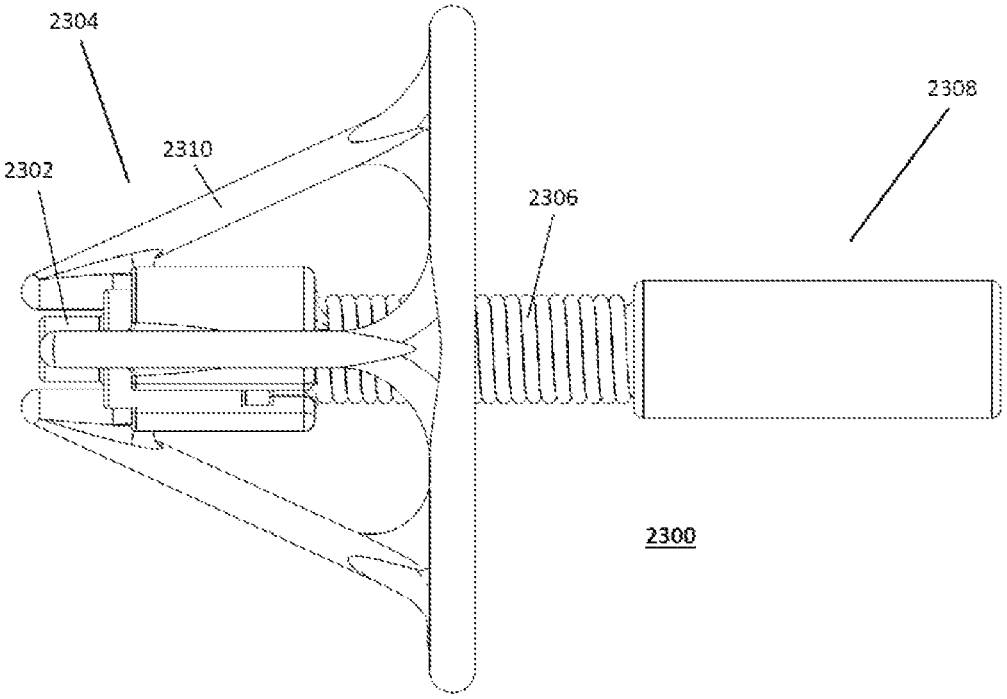
FIG. 23 is a side view of a test-microphone which is part of a test-microphone arrangement that can be coupled to the in-ear headphone, and shows a spring wire bracket and a plurality of bars.
Figure 24:
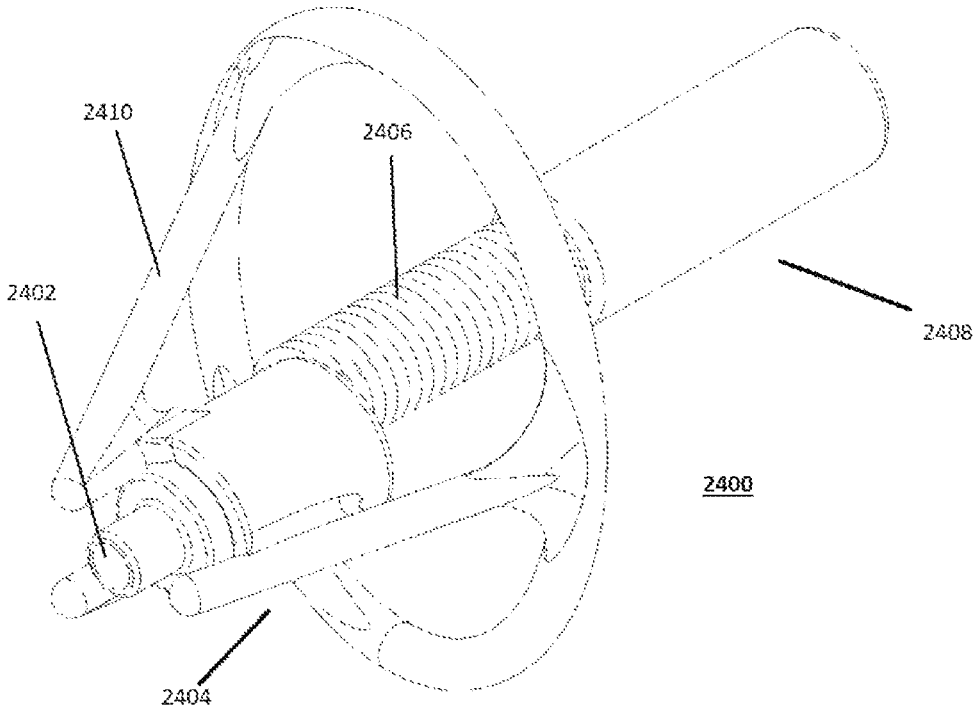
FIG. 24 is a perspective view of the test microphone.

To accurately measure the user-specific target function, an open ear drum response from an external sound source can be measured with a test microphone arrangement comprising two identical microphones as shown in FIGS. 23 and 24 for the left and right ears and an integrated circuit. The microphones can be placed within 1-5 mm of the entrance of the user's ear canal. Further details of the test microphone arrangement are discussed below and with regard to FIGS. 23 and 24. A third sound signal (such as a logarithmic sweep) may be generated by the external sound source (e.g. loudspeakers) which may be placed such that they are at right angles (90°) to the left and the right, respectively, from the user's face. Therefore, an accurate and direct sound signal can be ensured. The microphones of the test microphone arrangement can record the third sound signal at the entrance of the user's ear canal, and transmit the recorded third sound signal to the integrated circuit of the test microphone arrangement, where the third sound signal may be stored. Alternatively, the recorded third sound signal can be transmitted directly to the integrated circuit of the in-ear headphone, wherein the test microphone arrangement may be coupled (wired or wireless) to the in-ear headphone.

Figure 10:
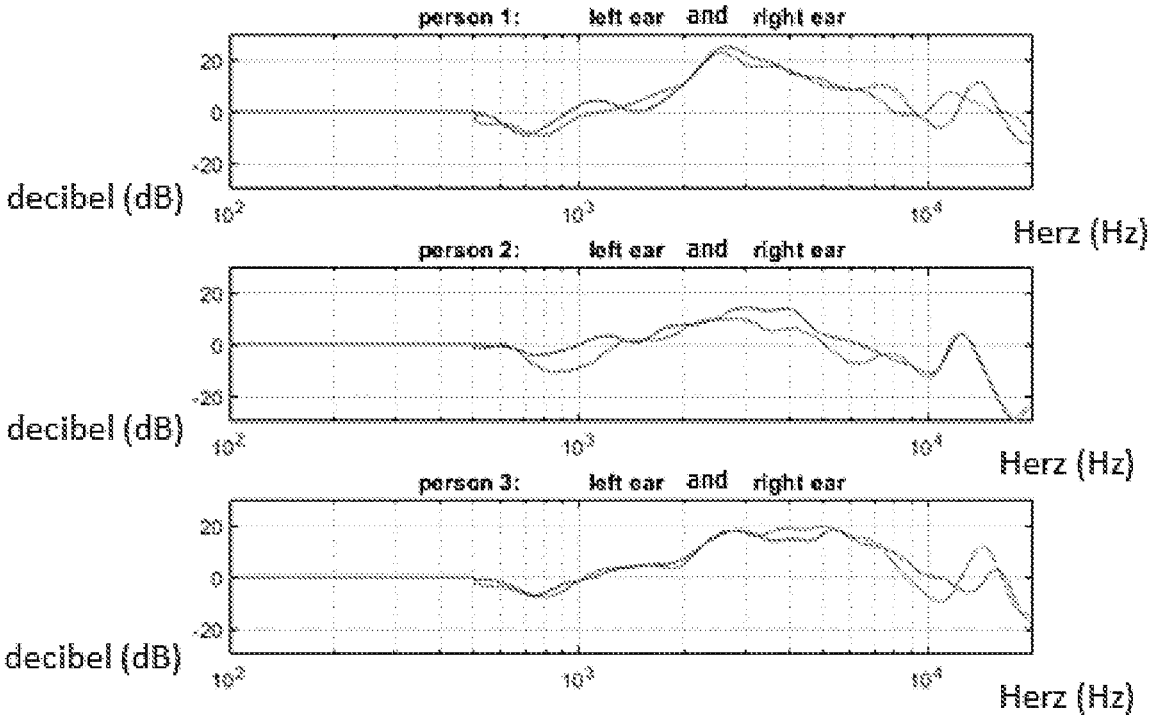
FIG. 10 shows example target functions (measurements of open ear drum responses (frequency responses) from an external sound source) of three test people recorded by a test microphone arrangement placed at the entrance of the users' left and right ear canals.

The integrated circuit of the in-ear headphone, or the integrated circuit of the test microphone arrangement can generate a frequency response for the user's left and right ear based on the inverse transfer function $H_{EQ}$ of a single stage acoustic transmission line model of the recorded third sound signals at the user's left ear and right ear, respectively. The inverse transfer function $H_{EQ}$ with $q_{out}=0$ as above corresponds to:

$$H_{EQ} = \left(\cosh\left(\frac{j2\pi f}{f_c} + \alpha\right)\right)^{-1} \quad \text{[Equation 5]}$$

with damping coefficient $\alpha$ and first peak frequency $f_c$. This function can be used to predict the ear drum response from a microphone situated at the entrance of the ear canal, or in other words the user-specific target function and identify which particular sound frequencies from outside sources are more or less prevalent for the individual. FIG. 10 shows example frequency responses (i.e. target functions) of three test people at the ear drum of the three users' left and right ear canals. The differences in measured frequency responses (target functions) demonstrate the need for individual modification (calibration) of sound reproduced at user's earphones.

The integrated circuit (for example, the equaliser coupled to the integrated circuit) of the in-ear headphone can further modify the above described second sound signal towards the frequency curve of the generated user-specific target function, thereby bringing the frequency response at the ear drum of the user's ear canal to a more desirable level.

In the above measurement of the user-specific target function, audible sound coloration can be introduced depending on where the third sound sources are located (e.g. side or front). To avoid such coloration, an average of frequency responses from sources distributed around the head can be recorded. Alternatively the test can be performed in a diffuse sound field from a multichannel home theatre system or a reverberant chamber to minimise sound coloration. However, the measurements are difficult to repeat with the same parameters and can, therefore, still lead to inaccurate results, depending on the test person's ear canal shape, correct seating of the microphone etc.

Figure 11:
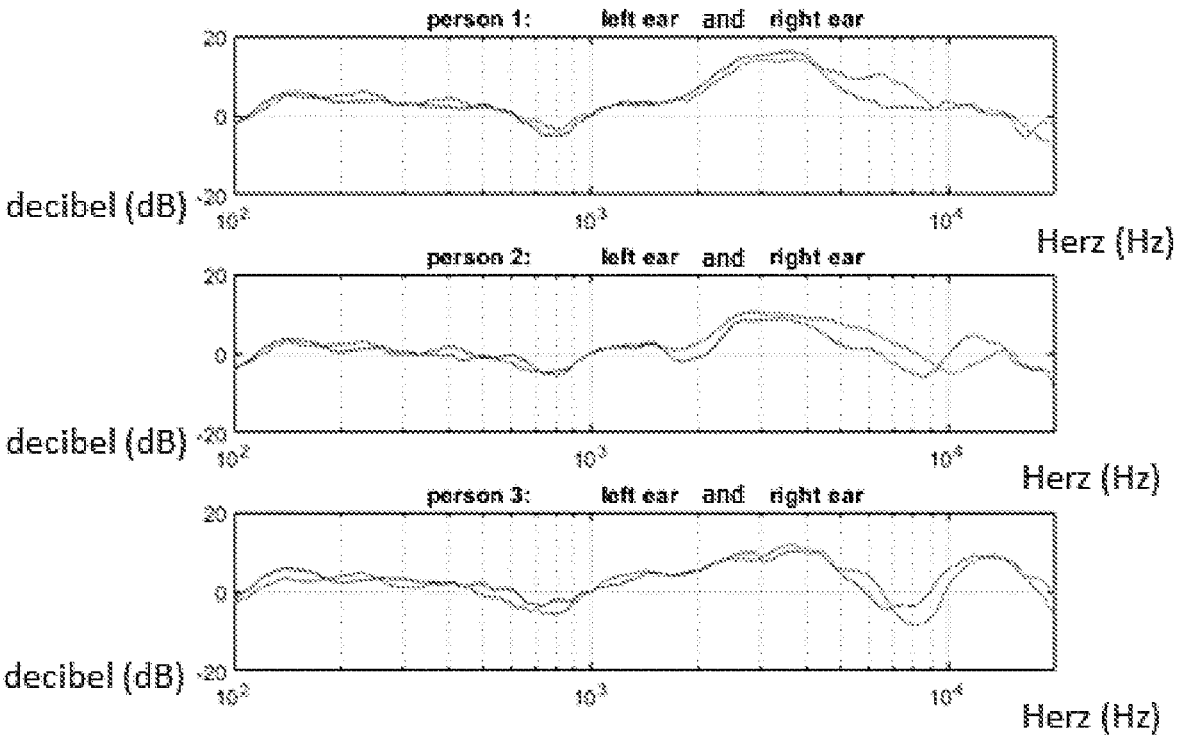
FIG. 11 shows example target functions (measurements of closed ear drum responses (frequency responses)) of three test people recorded by a second microphone of the in-ear headphone placed at the entrance of the users' left and right ear canals.

To address the issues of sound coloration, the user-specific target function can additionally be measured from a closed (as opposed to an open) ear drum response, wherein a closed ear drum response from an external sound source can be measured by a second microphone (facing outwards and opposite to the first microphone) within the in-ear headphone. An in-ear headphone, such as the in-ear headphone described with regard to FIGS. 21 and 22, can be placed in the user's left and right ear canals, wherein the second microphone of each (left and right) in-ear headphone faces outwards of the ear canal, with the in-ear headphone sitting flush with the user's outer ear (pinna). Therefore, the second microphone of each in-ear headphone may record the same third sound signal at the entrance of the user's ear canal and transmit the recorded sound signal to the integrated circuit of each (left and right) in-ear headphone. The integrated circuit of each in-ear headphones may then generate the frequency responses (i.e. user-specific target function at the left and right ears). Similarly, the second microphone and integrated circuit of each in-ear headphone may determine the Head Related Transfer Functions (HrTF) and/or Headphone Related Transfer Functions (HpTF) from the third sound source. FIG. 11 displays example target function (i.e. frequency response at the entrance of the ear canal) results of three test persons using the in-ear headphones each comprising a second microphone.

Figure 12:
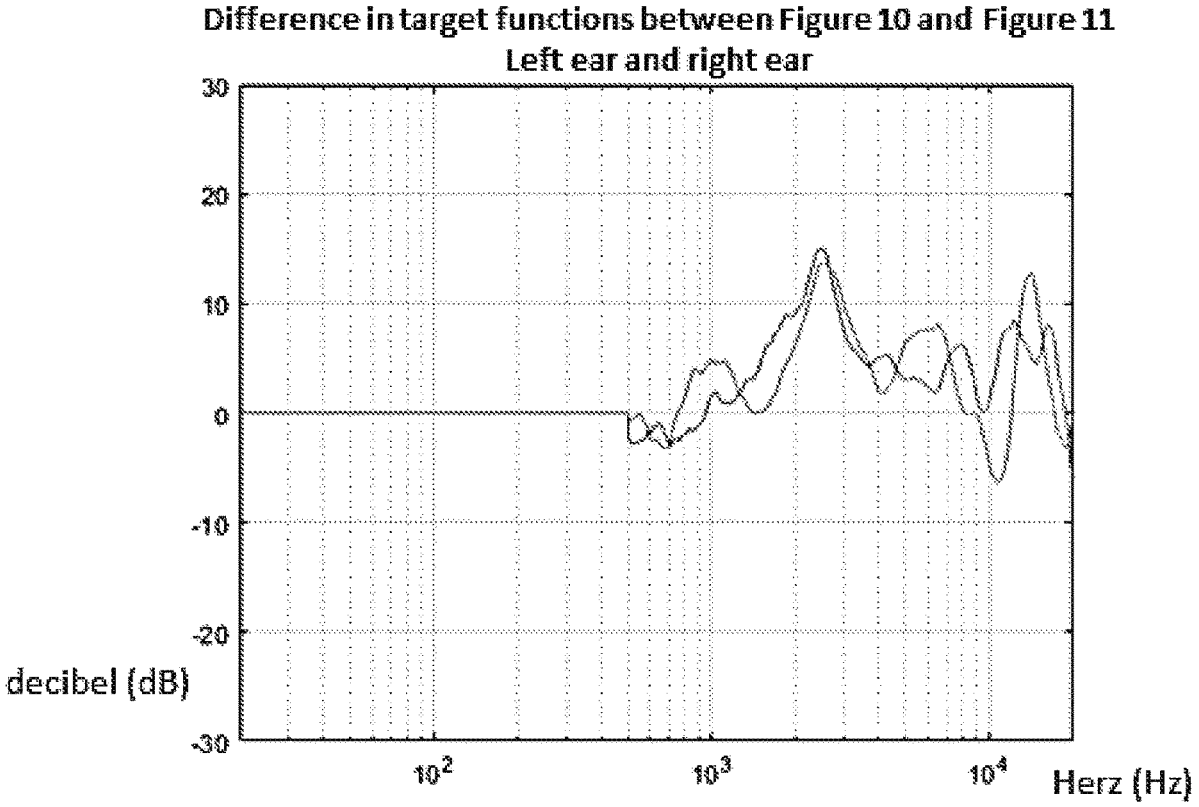
FIG. 12 shows the difference in target functions (frequency responses) between FIG. 10 and FIG. 11.

FIG. 12 shows a user-specific target function wherein the measurements obtained from the test microphone arrangement (i.e. open ear drum response) are normalised with respect to (i.e. subtracted from) the measurements of the second microphone of the in-ear headphone (i.e. closed ear drum response). This displays a more accurate user-specific target function (frequency response) at a user's ear drum from an external sound source, with minimised sound coloration effects. Therefore, in an embodiment, the user-specific target function can be further determined by integrated circuit of the in-ear headphones based on a difference between the closed ear drum response and the open ear drum response. The integrated circuit can therefore further modify (e.g. equalise) the above described second sound signal towards the user-specific target function as described above and in relation to FIG. 12, thereby bringing the frequency response at the entrance of the user's ear canal to a further still more desirable level (for example, such that the frequency response at the user's ear drum is substantially equalised towards the user's specific target function, such that the user experiences the intended sound generated by the driver).

Alternatively, the integrated circuit of the in-ear headphone can modify the second sound signal towards the measured user-specific target function of FIG. 11 (i.e. measured by the in-ear headphone) and without the initial measurement of the user-specific target function of FIG. 10 (i.e. measured by the test microphone arrangement). Therefore, the in-ear headphone can generate the user's specific target function and modify (e.g. equalise) the second sound signal towards that target function, thereby achieving intended sound generated by the driver at the user's ear drum, without the need of the separate test microphone arrangement.

Figure 13:
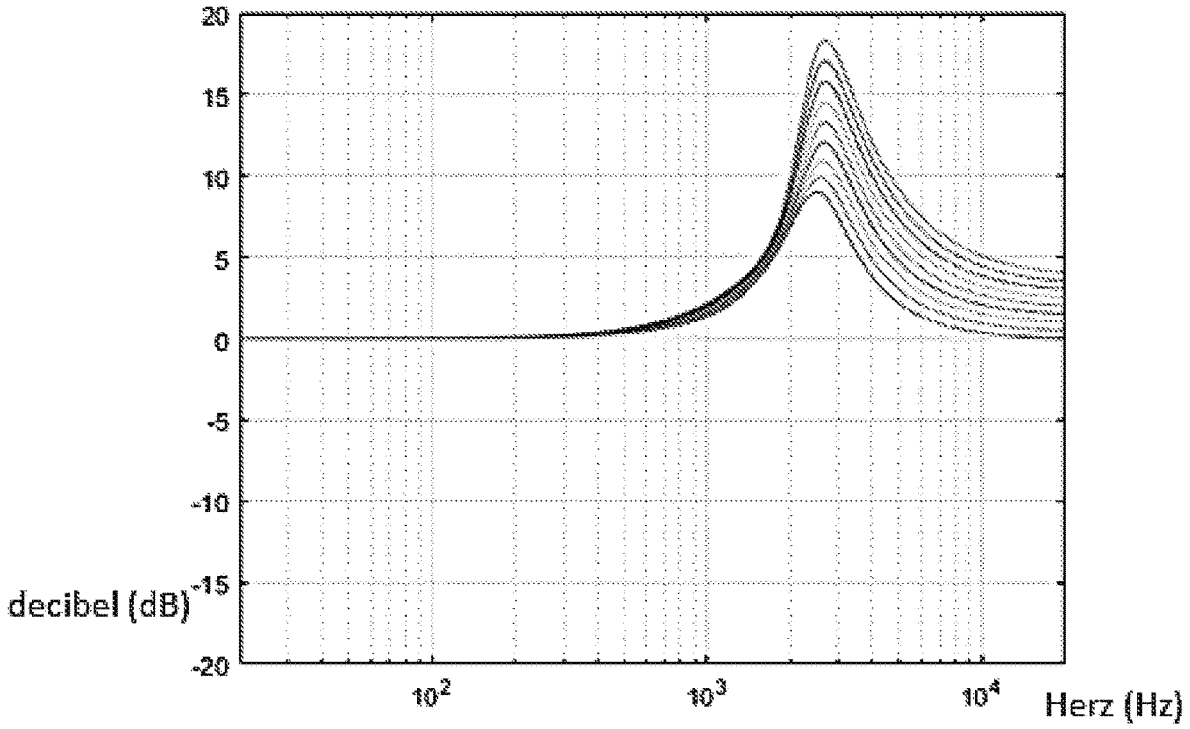
FIG. 13 shows multiple equaliser functions for fine adjustment of the target function of FIG. 12.

Following the measurement of the user's left and right target functions using either the test microphone arrangement of FIGS. 23 and 24 as described above, the second microphone of the in-ear headphone of FIGS. 21 and 22, or a combination of the two, a simplified equaliser function can be applied to implement the user-specific target function as shown in FIG. 13. The equaliser function can comprise a peak/notch filter followed by a shelving filter, controlled by the respective gains of each filter. The equaliser allows the user to manually adjust the final target function curve (i.e. the frequency response towards which the in-ear headphone will modify (e.g. equalise) the second sound source) for best individual sound quality.

Figure 14:
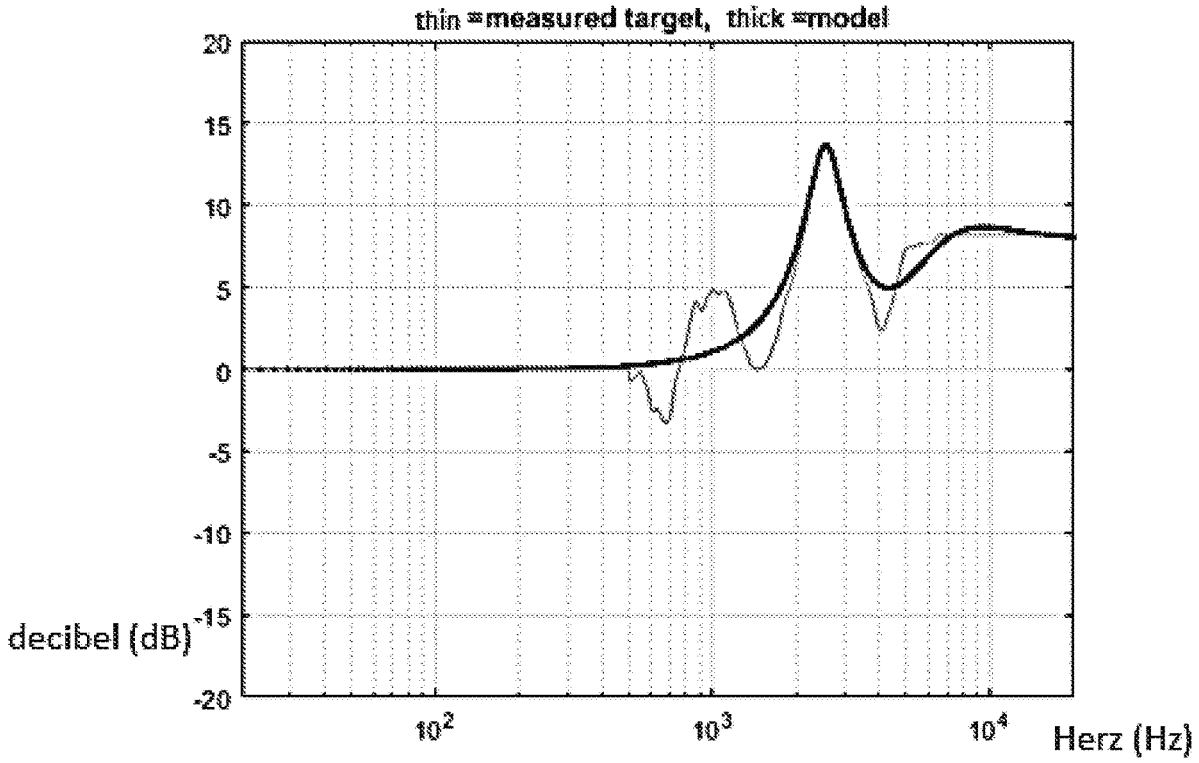
FIG. 14-15 show normalised target functions based on the target function of FIG. 12.
Figure 15:
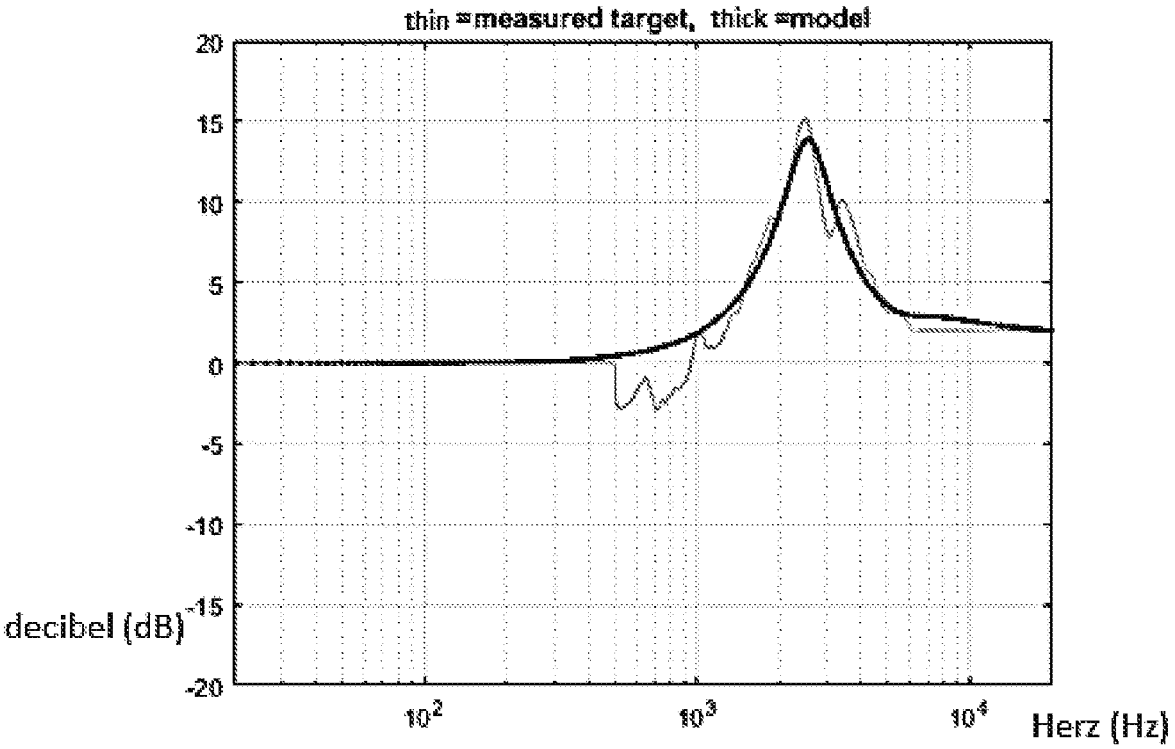

The target functions measured for the user's right and left ear in FIG. 12 can be normalised by the integrated circuit of the in-ear headphone with equaliser functions, as shown in FIG. 14 for the right ear and FIG. 15 for the left ear examples of normalised, measured target functions.

Figure 16:
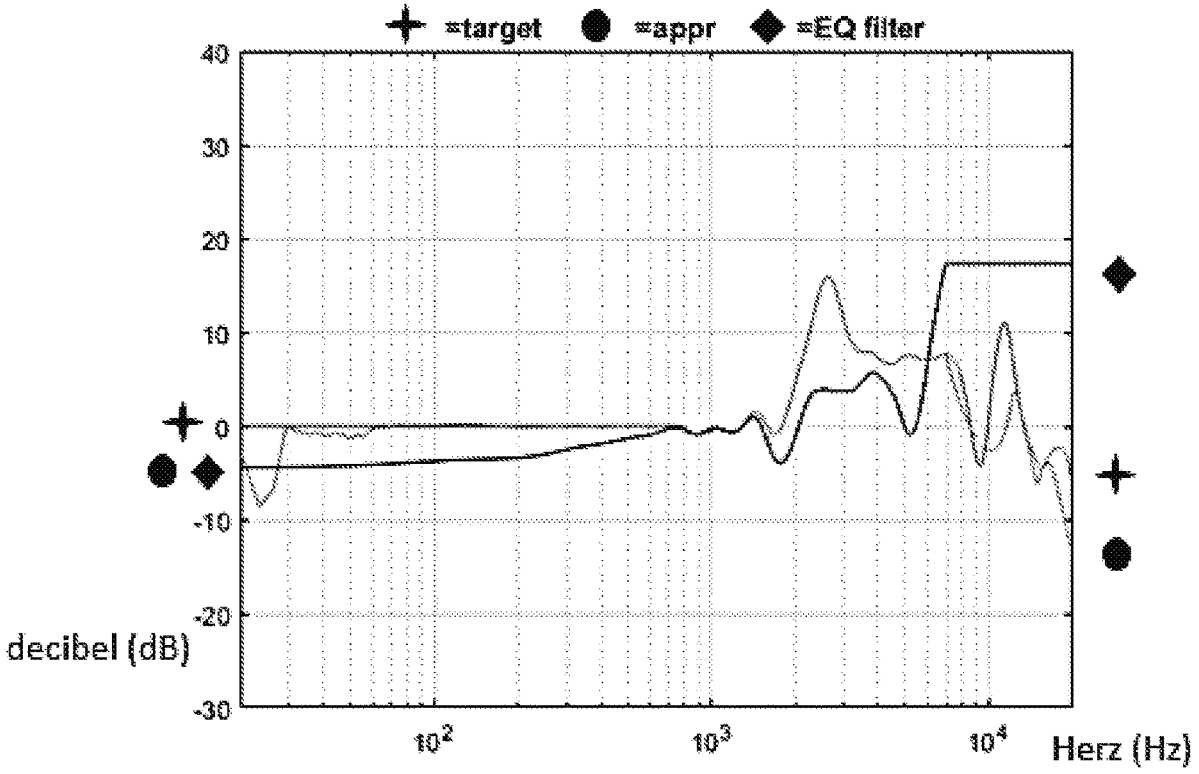
FIGS. 16-18 show example equaliser functions for three test people based on the subtraction of the ear drum responses of FIGS. 7-9 from the target functions of FIGS. 10-12.
Figure 17:
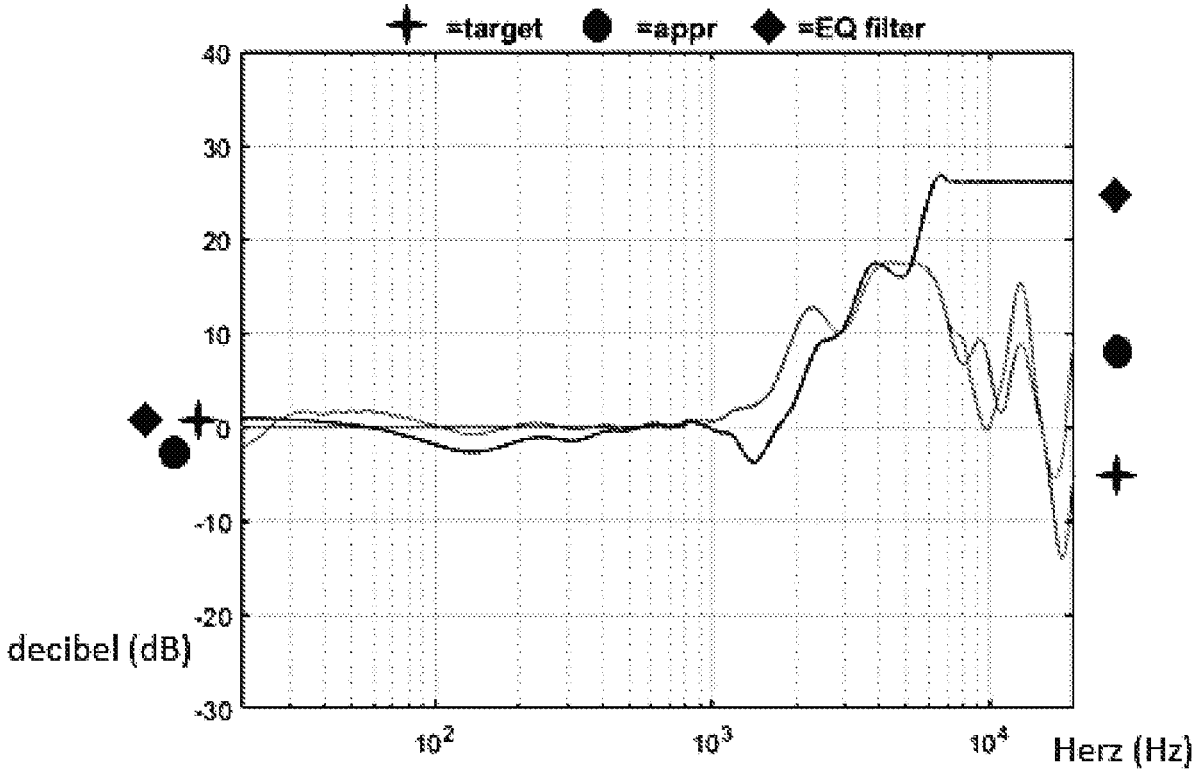
Figure 18:
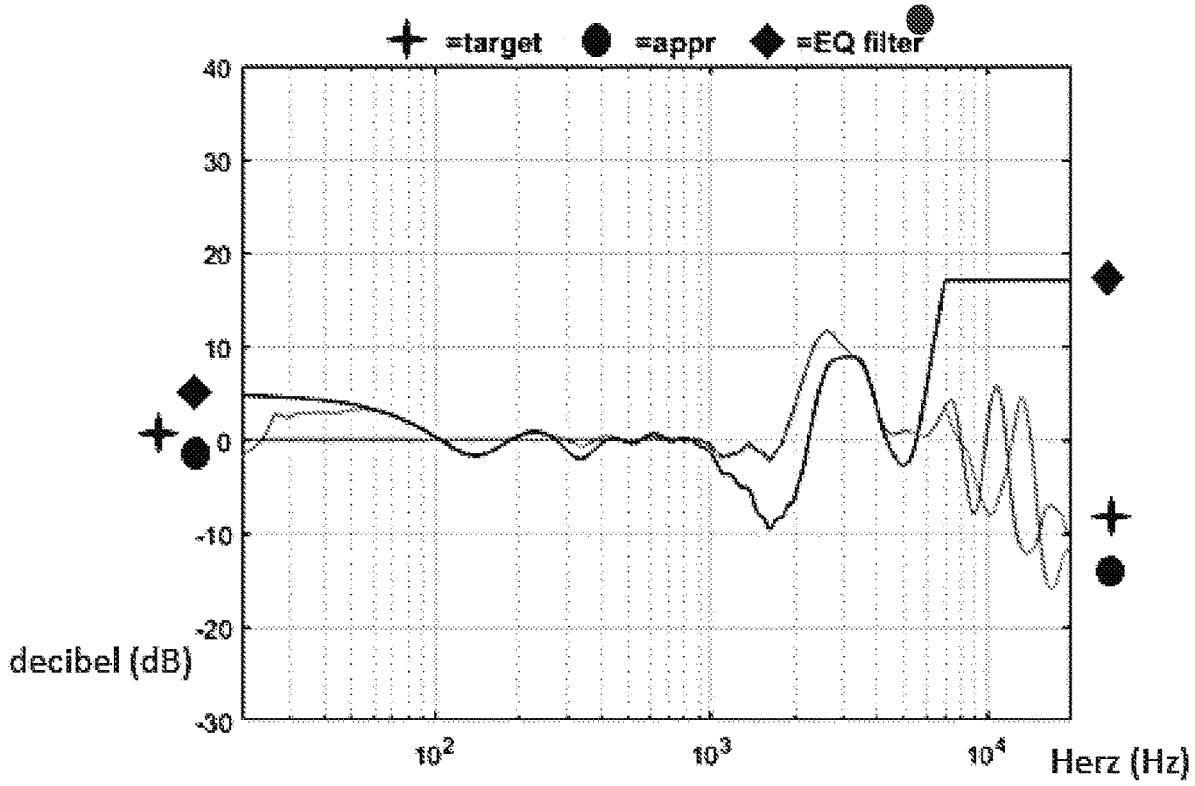

In an embodiment, the further modification of the second sound signal by the integrated circuit of the in-ear headphone can be based on a subtraction of the user's ear drum responses as shown in FIGS. 7 to 9 from the user's specific target function as shown in FIGS. 10 to 12 (or FIGS. 14 to 15). A final modification to the second sound signal for three test persons is shown in FIGS. 16 to 18, which results in a frequency response at the user's ear drum which most closely resembles the user's specific target function throughout the frequency range, such that the user experiences the intended sound generated by the driver). An upper band limit may be introduced at 8 KHz to avoid excessive boost at high frequencies. As shown in FIGS. 16 to 18, differences in the order of 10 dB are present in the final headphone equalisation filters, thereby justifying the need of individual calibration of in-ear headphones In an embodiment the integrated circuit may comprise a Digital Signal Processor (DSP) can be used that processes active noise cancellation (ANC) which comprises a latency of less than 20 μs. Minimising the latency results in a more stable sound transfer to the driver, and hence a more fluid experience for the user. Accordingly, normal binaural hearing can be improved while wearing the in-ear headphone.

Figure 19:
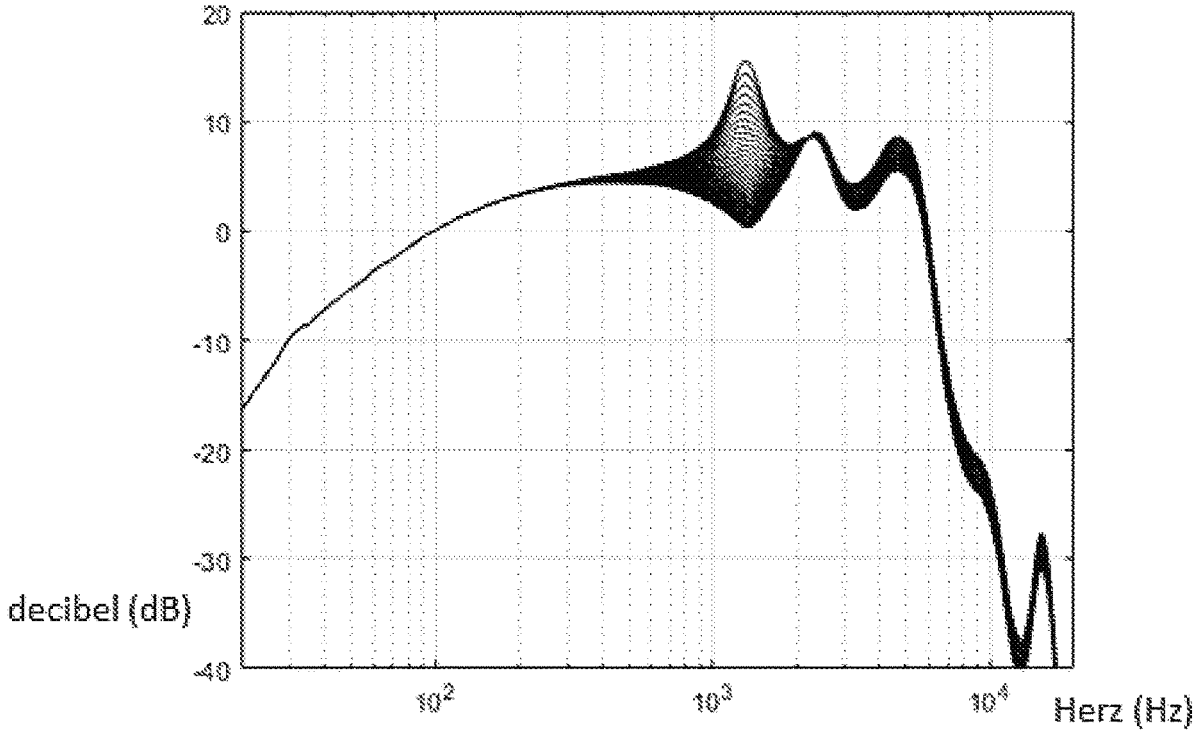
FIG. 19 shows an ear drum response with the two-stage transmission line calculation, wherein the damping coefficient is varied between 0.1 and 1 in intervals of 1 decimal place.
Figure 20:
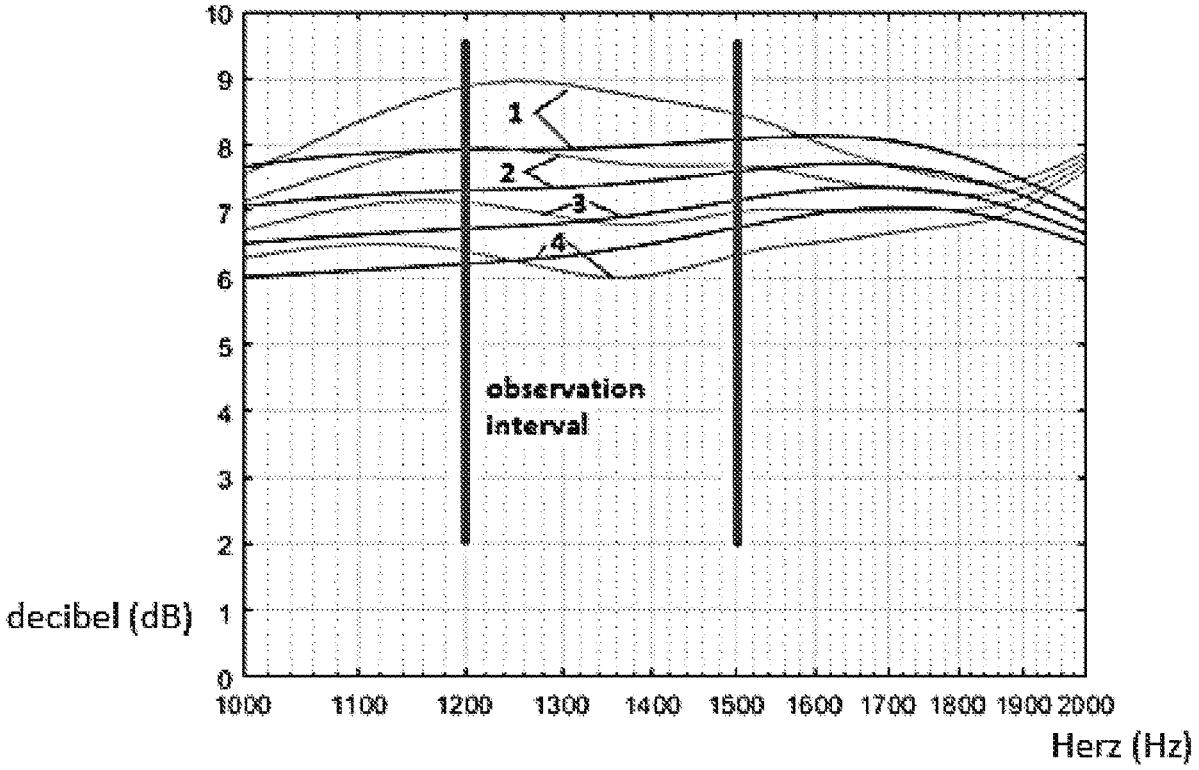
FIG. 20 shows an observation interval of FIG. 19 between 1200 Hz and 1500 Hz wherein a mild and strong smoothing calculation have been applied.

As discussed above, the damping coefficient can optionally be estimated indirectly to achieve a more accurate frequency response when generating the user's ear drum response from the driver of the in-ear headphone. For example, the damping coefficient $\alpha$ can be varied in intervals of 0.1 between 0.1 and 1 (e.g. 0.1, 0.2, 0.3, . . . 1.0). Multiple frequency response results can therefore be generated at the first microphone as shown in FIG. 19. The results can be observed in an observation interval (for example between 1200 Hz and 1500 Hz) and then smoothed in two stages (mild and strong smoothing as shown in FIG. 20). Smoothing of the curves in the observation interval can be performed according to the following equation:

$$|H_{sm}(\omega_k)| = \frac{1}{m_1 + m_2 - 1} \sum_{i=m_1}^{m_2} |H(\omega_i|, \quad \text{[Equation 6]}$$

with $$m_1(k) = \begin{cases} \lfloor k/s \rfloor \\ 1, \ \frac{k}{s} < 1 \end{cases},$$

$$m_2(k) = \begin{cases} \lfloor k/s \rfloor \\ N, \ ks > N \end{cases},$$

with a block length N=2048, and s=1.1 for the mildly smoothed curve, and s=1.5 for the strongly smoothed curve. The curve with the least area between the curves (e.g. curve pair 3 in FIG. 20) is the smoothest response and may be selected, thereby resulting in the destructive interference from the back wave in the ear canal to be fully compensated.

In an embodiment, the in-ear headphones can be placed in an "ambient listening mode", wherein the user hears/experiences ambient (i.e. background and environmental) sounds as if he/she were not wearing headphones. In the ambient listening mode, the second microphone of the in-ear headphone can record ambient sounds from the outside world which are temporarily stored in the integrated circuit of the in-ear headphone. The integrated circuit of the in-ear headphone can then modify the stored ambient sounds based on the user's ear drum response, the user's specific target function (for left and right ears), or a combination of the two, and transmit the modified ambient sounds to the driver of the in-ear headphone which can play the modified ambient sounds back to the user. Therefore, the user experiences binaural hearing and feels as though he/she hears naturally without timbre or localisation change, as if no headphones were worn. This allows for a small package of noise cancelling and sound proof in-ear headphones, which auto-calibrate the sound such that the user hears the intended sound (e.g. the intended frequency responses). Furthermore, the ambient listening mode allows for increased safety in moments where noise cancelling in-ear headphones previously posed a danger to the user (such as on a construction site or when a user is walking across a road).

To further improve the effect of hearing ambient noise as if no headphones were worn, the integrated circuit of the in-ear headphone may comprise a Digital Signal Processor (DSP) as described above. The DSP may have a latency of less than 20 μs. This ensures that the ambient sound recorded by the second microphone is relayed to the driver of the in-ear headphone such that user experiences ambient noises instantaneously.

The second microphone and the DSP as described above may be used to perform active noise cancellation (ANC) using well known methods. The in-ear headphone may also perform ANC with the second microphone and the integrated circuit (e.g. DSP) with or without the presence of the ambient listening mode within the in-ear headphone.

The steps described above may be performed with two in-ear headphones such that the user wears one in-ear headphone in each ear, thereby creating a binaural hearing experience.

In-Ear Headphone

FIG. 21 shows an exemplary in-ear headphone 2100 which can automatically be calibrated to modify sound received from an audio input (such as a mobile phone, laptop, MP3 player, or any other suitable sound source) as in the method as described above. The in-ear headphone comprises a housing 2102 which holds a first microphone 2108, a driver 2110, an integrated circuit (not shown) and may include a second microphone (2112). The first microphone 2108, second microphone 2112, and driver 2110 are each electrically coupled to the integrated circuit (not shown). The driver 2110 may be any well-known driver capable of playing back high-quality sound to a user. The driver 2110 may be a dynamic (moving coil) type driver and may be of a diameter of 5.8 mm. The first microphone 2108 and the second microphone 2112 may be standard ECM (electric capsules), analog MEMS, digital MEMS, or any other suitable microphone known in the industry.

The housing may comprise a wider "body portion" 2104 at one end and a narrower "nozzle portion" 2106 at the opposite end, affixed to the body portion 2104. The body portion 2104 may comprise the first microphone 2108 and the driver 2110 pointing in a direction towards the nozzle portion 2106 (i.e. towards the ear canal of the user). The body portion 2104 may also comprise the second microphone 2112 which points in an opposite direction to the first microphone 2108 (i.e. away from the user's ear canal and outwards) such that it can record ambient (e.g. environmental and background) noises. The body portion 2104 of the in-ear headphone 2100 may also comprise the integrated circuit (not shown). The nozzle portion 2106 can be an elongated tube shape which comfortably fits into a user's ear canal. The nozzle portion 2106 may have a maximum diameter of 3 mm. On one end, the nozzle portion 2106 can be affixed to the body portion 2104, whereas the opposite end of the nozzle portion 2106 comprises a lip suitable for placing well known ear tips of varying sizes (e.g. silicon or rubber ear tips from the hearing industry) onto the in-ear headphone 2100 as described above.

The nozzle portion 2106 may comprise a first passage/nozzle/canal 2114 which can directly couple the driver 2110 to an exit aperture of the in-ear headphone 2100, therefore providing a direct source of sound from the in-ear headphone 2100 to the user's ear canal. Furthermore, the nozzle portion 2106 may comprise a second passage/nozzle/canal 2116 (equivalent to the nozzle and first transmission line as discussed above with regard to the method) which can couple the first microphone 2108 to the first passage/nozzle/canal 2114. The second passage/nozzle/canal 2116 may have a substantially smaller cross-sectional area than the first passage/nozzle/canal's 2114 cross-sectional area (for example, the second passage/nozzle/canal 2116 may have a cross-sectional area of 0.28 $mm^2$ and the first passage/nozzle/canal 2114 may have a cross-sectional area of 2.29 $mm^2$). The second passage/nozzle/canal 2116 can be mounted to the first passage/nozzle/canal 2114) at a bent angle, as shown in FIG. 21. This minimizes complex acoustic interactions at the exit of the second passage/nozzle/canal 2116 with the reflected back-wave from the user's ear canal, when the in-ear headphone is placed in the user's ear.

The in-ear headphone 2100 may comprise a transceiver (not shown) to allow it to communicate wirelessly with an audio input sound source (such as a mobile phone, laptop, MP3 player, or any other suitable sound source). Alternatively or additionally, the in-ear headphone 2100 may comprise any standard connection to couple a wire between the in-ear headphone 2100 and the audio input sound source. Furthermore, the in-ear headphone 2100 may comprise additional wired and/or wireless connections to couple a test microphone arrangement as in FIGS. 23 and 24 to the in-ear headphone 2100, as described later.

FIG. 22 shows an exemplary block diagram of the in-ear headphone 2100 and the integrated circuit within it. For example, the integrated circuit may comprise a first core processor 2202 coupled to a second core processor 2204. The first processor 2202 may be an active noise cancellation (ANC) processor, and the second processor 2204 may be a multi-chip unit (MCU). The ANC processor may be a Digital Signal Processor (DSP) or any other suitable processor with a delay time (latency) of less than 20 μs, which can ensure that a negative feedback ANC control loop is stable over a sufficient frequency bandwidth. The ANC may be coupled to the first microphone 2208, the second microphone 2210 and the driver 2206 with analogue-to-digital (A/D) or digital-to-analogue (D/A) convertors 2212 placed between the microphones/drivers and the ANC. The ANC may also be coupled to the audio input sound source 2214. The ANC may comprise a first equaliser 2216 to perform standard noise cancellation functions by equalising the acoustic path of the second microphone 2210 and the audio input sound source 2214. The ANC may also comprise a second equaliser 2218 to perform the modifying (e.g. equalising) functions of sound as described in the method section in more detail.

The MCU 2204 may generate the sound signal to be played to the user while the user is wearing the in-ear headphone 2100, with the goal of generating the user's ear drum response and user-specific target function, as described earlier. The MCU 2204 may also be coupled (wireless or wired) to the test microphone arrangement 2300, 2400 as described later, to measure part of the user's specific target function. The MCU 2204 can also be used to record ambient (e.g. environmental or background) sound or logarithmic sound signals (as described above) via the second microphone 2210, from both ears simultaneously, which can later be played back from memory. Other applications that may run in the MCU 2204 are rendering of multi-channel stereo music via a binaural processor (3D audio), or augmented audio/machine learning algorithms.

Test Microphone Arrangement

FIGS. 23 and 24 show a test microphone 2300, 2400 to accurately measure a user's specific target function as described in more detail above. The test microphone 2300, 2400 may be part of a test microphone arrangement comprising two identical test microphones 2300, 2400 coupled to the in-ear headphone 2100, 2200. The test microphone arrangement may also comprise an integrated circuit coupled directly to the two test microphones 2300, 2400. The test microphone arrangement may be worn by a user to measure the acoustic sound pressure (frequency response) at the entrance of a user's ear canal from an external sound source (e.g. a loudspeaker as described above) to determine the user's specific target function. The microphones 2302, 2402 of the test microphone may each be mounted on a first side 2304, 2404 of spring wire bracket 2306, 2406, the second and opposite side 2308, 2408 being coupled (directly or indirectly) to the in-ear headphone 2100, 2200. The spring wire bracket 2306, 2406 can ensure that unwanted feedback from the cable and/or receiver placed on the opposite side 2308, 2408 of the spring wire bracket 2306, 2406 is not recorded by the microphones 2302, 2402. The microphones 2302, 2402 can be mounted such that they are positioned at 1-5 mm from the entrance of the user's ear canal.

The first side 2304, 2404 of each spring wire bracket 2306, 2406 may further comprise a plurality of bars 2310, 2410 (e.g. three or more) mounted around the microphones 2302, 2402, to make sure the microphones 2302, 2402 are guided into ear canals of all sizes, thereby creating a universal fit without creating an air-tight seal. The bars 2310, 2410 may be constructed from plastic, metal, rubber, or any combination thereof

What is claimed is:

1. A method for calibrating an in-ear headphone comprising:

generating, by an integrated circuit, a first sound signal;

playing, by a driver, the first sound signal when the in-ear headphone is placed within an ear canal of a user;

receiving a reflected sound signal at a first microphone;

generating, by the integrated circuit, a first frequency response based on the reflected sound signal;

determining one or more characteristics of an ear canal of the user;

determining, by the integrated circuit and based on at least the first frequency response and the one or more characteristics of the ear canal, a user ear drum response of the user;

generating, by the integrated circuit, a second sound signal;

modifying, by the integrated circuit, and based on the user ear drum response, the second sound signal to generate a modified second sound signal; and playing, by the driver, the modified second sound signal.

2. The method of claim 1, wherein the first sound signal generated by the integrated circuit is a logarithmic sweep.

3. The method of claim 1, wherein determining the one or more characteristics of the ear canal of the user comprises:

determining a length of the ear canal of the user from a first minimum of the first frequency response; and estimating a damping coefficient of the ear canal of the user.

4. The method of claim 3, further comprising:

varying, by the integrated circuit, the damping coefficient in intervals of 0.1 between 0.1 and 1;

smoothing, by the integrated circuit, the user ear drum response; and selecting, by the integrated circuit, a frequency response with a smoothest response.

5. The method of claim 1, further comprising applying a microphone equaliser to the first microphone, wherein the first microphone is coupled to a nozzle, and the microphone equaliser is based on a comparison between:

a frequency response received by the first microphone attached to the nozzle; and a frequency response received directly by the first microphone without the nozzle.

6. The method of claim 1, further comprising:

generating, by a second driver, separate from the in-ear headphone, a third sound signal;

receiving the third sound signal at an entrance of the ear canal of the user;

storing the third sound signal in the integrated circuit of the in-ear headphone; and generating, by the integrated circuit, a second frequency response based on the received third sound signal, the second frequency response corresponding to a user target function;

wherein modifying, by the integrated circuit, the second sound signal based on the user ear drum response further includes modifying, by the integrated circuit, the second sound signal towards the user target function.

7. The method of claim 6, wherein:

the third sound signal is received at a second microphone of the in-ear headphone, wherein the second microphone is placed opposite to the first microphone and on an outside of the in-ear headphone; or the third sound signal is received at a test microphone arrangement coupled to the in-ear headphone.

8. The method of claim 7, further comprising placing the in-ear headphone in an ambient listening mode, the ambient listening mode comprising:

receiving, by the second microphone, ambient sounds;

storing the ambient sounds in the integrated circuit;

modifying the stored ambient sounds based on:

the user ear drum response, the user target function, or a combination of the user ear drum response and the user target function; and playing the modified ambient sound at the driver of the in-ear headphone.

9. The method of claim 7, further comprising:

performing, by the integrated circuit in connection with the second microphone, active noise cancellation.

10. The method of claim 6, wherein:

the third sound signal is received at a second microphone of the in-ear headphone, wherein the second microphone is placed opposite to the first microphone and on an outside of the in-ear headphone;

a fourth sound signal identical to the third sound signal is generated, by a third driver separate from the in-ear headphone, wherein:

the fourth sound signal is received at the entrance of an ear of the user by a test microphone arrangement coupled to the in-ear headphone, and a third frequency response is generated based on the fourth sound signal; and the user target function is further determined based on a difference between the third frequency response and a fourth frequency response.

11. An in-ear headphone comprising:

a housing comprising a body portion and a nozzle portion, wherein the nozzle portion comprises an aperture therein;

a driver within the housing;

a first microphone within the housing;

a second microphone opposite the first microphone within the housing; and an integrated circuit coupled to the first microphone, the second microphone, and the driver, the integrated circuit operable to perform steps comprising:

generating a first sound signal;

playing the first sound signal by the driver when the in-ear headphone is placed within an ear canal of a user;

receiving a reflected sound signal at the first microphone;

generating a first frequency response based on the reflected sound signal;

determining one or more characteristics of an ear canal of the user;

determining a user ear drum response of the user based on at least the first frequency response and the one or more characteristics of the ear canal;

generating a second sound signal;

modifying, based on the user ear drum response, the second sound signal to generate a modified second sound signal; and playing the modified second sound signal by the driver.

12. The in-ear headphone of claim 11, further comprising:

a first connecting canal affixed to the aperture and the driver; and a second connecting canal comprising:

a first end affixed to the first microphone, and a second end affixed to the first connecting canal at a curve.

13. The in-ear headphone of claim 12, wherein a cross-sectional area of the second connecting canal is substantially smaller than a cross-sectional area of the first connecting canal.

14. The in-ear headphone of claim 11, wherein the first sound signal generated by the integrated circuit is a logarithmic sweep.

15. The in-ear headphone of claim 11, wherein determining the one or more characteristics of the ear canal of the user comprises:

determining a length of the ear canal of the user from a first minimum of the first frequency response; and estimating a damping coefficient of the ear canal of the user.

16. The in-ear headphone of claim 11, wherein the steps further comprise applying a microphone equaliser to the first microphone, wherein the first microphone is coupled to a nozzle, and the microphone equaliser is based on a comparison between:

a frequency response received by the first microphone attached to the nozzle; and a frequency response received directly by the first microphone without the nozzle.

17. The in-ear headphone of claim 11, wherein the steps further comprise:

generating, by a second driver separate from the in-ear headphone, a third sound signal;

receiving the third sound signal at an entrance of the ear canal of the user;

storing the third sound signal in the integrated circuit of the in-ear headphone; and generating, by the integrated circuit, a second frequency response based on the received third sound signal, the second frequency response corresponding to a user target function;

wherein modifying, by the integrated circuit, the second sound signal based on the user ear drum response further includes modifying, by the integrated circuit, the second sound signal towards the user target function.

18. The in-ear headphone of claim 11, wherein:

a third sound signal is received at the second microphone; or the third sound signal is received at a test microphone arrangement coupled to the in-ear headphone.

19. A system comprising:

an in-ear headphone comprising:

a housing comprising a body portion and a nozzle portion, wherein the nozzle portion comprises an aperture therein;

a driver within the housing;

a first microphone within the housing;

a second microphone opposite the first microphone within the housing; and an integrated circuit coupled to the first microphone, the second microphone, and the driver; and a test microphone arrangement coupled to the in-ear headphone, the test microphone arrangement including a third and a fourth microphone operable for recording a frequency response at an entrance of an ear canal of a user from an external sound source, wherein the integrated circuit is operable to perform steps comprising:

generating a first sound signal;

playing, by the driver, the first sound signal when the in-ear headphone is placed within the ear canal of the user;

receiving a reflected sound signal at the first microphone;

generating a first frequency response based on the reflected sound signal;

determining one or more characteristics of an ear canal of the user;

determining a user ear drum response of the user based on at least the first frequency response and the one or more characteristics of the ear canal;

generating a second sound signal;

modifying, based on the user ear drum response, the second sound signal to generate a modified second sound signal; and playing, by the driver, the modified second sound signal.

20. The system of claim 19, wherein:

the third microphone and the fourth microphone are each affixed to a first side of separate spring wire brackets, a second and opposite side of the spring wire brackets being coupled to the in-ear headphone; and a first end of each spring wire bracket further comprises a plurality of bars affixed to the spring wire bracket suitable for holding the third and fourth microphones in the ear canal of the user without creating an air-tight seal.

* * * * *